US010253523B2

(12) United States Patent
Volin

(10) Patent No.: US 10,253,523 B2
(45) Date of Patent: Apr. 9, 2019

(54) TICK-PREVENTING MULTI-FUNCTION-LATCH-PULLEY-HANDLE AND MULTI-FUNCTION-LATCH-PULLEY-WHEEL POPUP, HAVING POST-CENTERING BRACES, WATER-DISCHARGING RECESSES, TICK-PREVENTING TEETH, LATCH-PULLEY-HANDLES, AND LATCH-PULLEY-WHEELS

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 0 days.

(21) Appl. No.: 16/008,013

(22) Filed: Jun. 13, 2018

(65) Prior Publication Data

US 2018/0363320 A1 Dec. 20, 2018

Related U.S. Application Data

(60) Provisional application No. 62/521,365, filed on Jun. 16, 2017.

(51) Int. Cl.
*E04H 15/50* (2006.01)
*E04H 15/60* (2006.01)
(Continued)

(52) U.S. Cl.
CPC ..... *E04H 15/50* (2013.01); *E04H 15/322* (2013.01); *E04H 15/505* (2013.01); *E04H 15/60* (2013.01); *E04H 15/64* (2013.01)

(58) Field of Classification Search
USPC ..... 135/146, 147, 159, 912
See application file for complete search history.

(56) References Cited

U.S. PATENT DOCUMENTS 2,799,286 A * 7/1957 Nordmeyer ..... E04H 15/06 135/118
3,199,518 A 8/1965 Glidewell
(Continued)

FOREIGN PATENT DOCUMENTS

DE 20 2017 100 227 U1 * 3/2017 ..... E04H 15/60
JP 2001288933 A * 10/2001 ..... E04H 15/50
JP 3123507 U * 7/2006 ..... H03K 19/00315

*Primary Examiner* — Robert Canfield

(57) ABSTRACT

A tick-preventing multi-function-latch-pulley-handle and multi-function-latch-pulley-wheel popup comprises four-way circular roof intersector, foldable roof trusses, foldable side trusses, four upper corner intersectors and four lower corner intersectors each being able to be adjusted up and down, four automatic rounded-head see-saw post locks and four see-saw-post-lock springs respectively attached to the four lower corner intersectors for locking and unlocking upper corner intersectors, four multi-function latch-pulley-handles respectively and pivotably attached to the four upper corner intersectors for functioning as latches to wrap on the side trusses to lock the popup when folded and for also functioning as pulleys to wrap cables thereon and for also functioning as handles to unfold the popup, four upper octagonal posts, four multi-function post-centering water-discharging tick-preventing braces respectively attached to the four upper octagonal posts, tick-preventing downward teeth and water-discharging recesses, respectively molded to the four multi-function post-centering water-discharging tick-preventing braces for preventing ticks from entering the popup posts and allowing water drainage to protect pets and other occupants, post-height-adjusting tapered holes respectively inserted into four lower octagonal posts, wheel chassis respectively attached to the four lower octagonal posts, and multi-function latch-pulley-wheel rotatably attached to the wheel chassis for functioning as latches to hook cables thereon and for also functioning as pulleys to wrap cables thereon to tension the popup canopy and for also functioning as wheels to roll the popup along the ground.

20 Claims, 39 Drawing Sheets

(51) Int. Cl.
*E04H 15/64* (2006.01)
*E04H 15/32* (2006.01)

(56) References Cited

U.S. PATENT DOCUMENTS

| | | | | |
|---|---|---|---|---|
| 4,947,884 | A | 8/1990 | Lynch | |
| D365,884 | S | 1/1996 | Dennis | |
| 5,511,572 | A | 4/1996 | Carter | |
| 5,701,923 | A | 12/1997 | Losi, Jr. | |
| D445,916 | S | 7/2001 | Pritchard | |
| 6,470,902 | B1 | 10/2002 | Carter | |
| 6,502,597 | B2 | 1/2003 | Carter | |
| 6,508,262 | B1 * | 1/2003 | Takayama | E04H 15/50 135/114 |
| 7,380,563 | B2 * | 6/2008 | Seo | E04H 15/32 135/114 |
| 7,395,830 | B2 | 7/2008 | Ted Cannaday | |
| 7,422,026 | B2 * | 9/2008 | Kim | E04H 15/50 135/120.2 |
| 7,428,908 | B2 | 9/2008 | Seo | |
| RE40,657 | E * | 3/2009 | Suh | E04H 15/46 135/114 |
| 7,775,229 | B2 | 8/2010 | Sy-Facunda | |
| 7,836,908 | B2 | 11/2010 | Sy-Facunda | |
| 8,215,326 | B2 | 7/2012 | Park | |
| 8,220,476 | B2 | 7/2012 | VanElverdinghe | |
| 8,220,477 | B2 | 7/2012 | Park | |
| 8,544,489 | B2 | 10/2013 | Choi | |
| 8,616,226 | B2 | 12/2013 | Ma | |
| 8,701,692 | B2 | 4/2014 | Holland | |
| 8,746,267 | B2 * | 6/2014 | Lovley, II | E04H 15/50 135/120.2 |
| 8,978,680 | B2 | 3/2015 | Kayser | |
| 9,103,138 | B2 | 8/2015 | Lovley, II | |
| 9,279,269 | B2 | 3/2016 | Lovley, II | |
| 9,528,292 | B1 | 12/2016 | Lovley, II | |
| 2002/0074032 | A1 * | 6/2002 | Park | E04H 15/50 135/131 |
| 2006/0062632 | A1 * | 3/2006 | Jang | E04H 15/46 403/109.6 |
| 2006/0169311 | A1 * | 8/2006 | Hwang | E04H 15/50 135/142 |
| 2007/0240748 | A1 | 10/2007 | Bae | |
| 2014/0030012 | A1 * | 1/2014 | Lee | F16B 7/105 403/326 |
| 2014/0099155 | A1 * | 4/2014 | Chen | E04H 15/46 403/83 |
| 2016/0060896 | A1 * | 3/2016 | Toohey | E04H 15/32 135/120.1 |
| 2016/0168874 | A1 | 6/2016 | Lovley, II | |

* cited by examiner

TICK-PREVENTING MULTI-FUNCTION-LATCH-PULLEY-HANDLE AND MULTI-FUNCTION-LATCH-PULLEY-WHEEL POPUP, HAVING POST-CENTERING BRACES, WATER-DISCHARGING RECESSES, TICK-PREVENTING TEETH, LATCH-PULLEY-HANDLES, AND LATCH-PULLEY-WHEELS

1. FIELD OF THE INVENTION

The present invention relates to a portable popup, which is cheap to produce, is easy to ship as one unit, requires little assembly, and can be quickly and easily be unfolded. Particularly, the present invention relates to a tick-preventing multi-function-latch-pulley-handle and multi-function-latch-pulley-wheel popup, having:

1) Post-centering braces,
2) Water-discharging recesses,
3) Tick-preventing teeth,
4) Multi-function latch-pulley-handles, and
5) Multi-function latch-pulley-wheels.

2. DESCRIPTION OF THE PRIOR ART

A number of portable popups have been introduced.

U.S. Pat. No. 3,199,518, issued 1965 Aug. 10, to Herman A Glidewell, relates to a collapsible and foldable frame which may be employed as a shelter when suitable covering material is placed thereover. The device herein disclosed is primarily intended as a collapsible frame over which camouflage material can be placed to provide a hunting blind, but would, of course, be employed as a frame over which any desired covering material (such as a tarpaulin) could be placed to provide protection against the weather.

U.S. Pat. No. 4,947,884, issued 1990 Aug. 14, to James P. Lynch, relates to a canopy shelter which has a plurality of corner support forming legs that may be positioned on a support surface. Scissor assemblies interconnect adjacent ones of the corner supports and are each pivotally connected at one portion to the top ends of the respective corner supports and are each pivotally connected at another portion to slide brackets slideably mounted on each of the respective corner supports. Roof support members are pivotally connected to a respective slide bracket on a corner support. Thus, the framework may be collapsed in a stored state yet expanded to an expanded state by spreading the corner members apart from one another.

U.S. Pat. No. 5,511,572, issued 1996 Apr. 30, to Mark C. Carter, describes a collapsible shelter including a truss and canopy framework that permits a flexible, collapsible canopy to be moved between a raised position and a lowered position. The collapsible shelter includes at least three legs supporting flexible poles removably mounted to the tops of the legs and forming the framework of the canopy. X-shaped truss pairs of link members are connected to each of the legs on each side of the shelter between adjacent legs.

U.S. Pat. No. 5,701,923, issued 1997 Dec. 30, to Raymond Losi, Jr., describes a shelter frame having at least two poles connected by a linking assembly having first and second scissors-type linkages and a linking device. The scissors-type linkages include first structural members pivotally coupled to respective second structural members and to one another.

U.S. Pat. No. 6,470,902, issued 2002 Oct. 29, to Mark C. Carter, discloses a quickly erectable canopy shelters include a plurality of legs connected together by an extendible perimeter assembly of link members. The roof structure is formed by a pole members pivotally mounted to the upper ends of the legs so as to extend across the shelter, and movable between a lowered position and a raised, upwardly arching position. The pole members are pivotally coupled to a central hub, and each of the pole members is formed of pole sections hinged to permit downward folding and upward unfolding until they are fully extended.

U.S. Pat. No. 6,502,597, issued 2003 Jan. 7, to Mark C. Carter, describes a lightweight erectable canopy shelters include a plurality of legs connected together by an extendible perimeter assembly of link members. In one embodiment, the roof structure is formed by a pole members pivotally mounted to the upper ends of the legs so as to extend across the shelter, and movable between a lowered position and a raised, upwardly arching position. The pole members are pivotally coupled to a central hub, and each of the pole members comprises pole sections hinged to permit downward folding and upward unfolding until they are fully extended.

U.S. Pat. No. 7,395,830, issued 2008 Jul. 8, to Ted Cannaday, relates to a locking pin assembly which includes a button that can be moved in a first direction from a first position to a second position, and a first biasing member for biasing the button to be normally in the first position. The locking pin assembly also includes a locking pin member that engages the button and is movable in a second direction, which is substantially perpendicular to the first direction, from a third position to a fourth position when the button is moved from the first position to the second position. The locking pin assembly also includes a second biasing member for biasing the locking pin member to be normally in the third position.

U.S. Pat. No. 7,428,908, issued 2008 Sep. 30, to Dong Woog Seo, relates to a collapsible canopy frame which is provided that includes a first truss bar having a surface that defines an opening; a second truss bar having a surface that defines an opening that is aligned with the first truss bar opening; and a connector assembly that pivotally connects the first truss bar to the second truss bar. The connector assembly includes a locking plate at a second end of the connector assembly having a base that defines first and second surfaces with an opening extending therebetween, wherein the first base surface abuts the second truss bar; and a fastener having a main body that extends through each of the first and second truss bar openings and the locking plate base opening.

U.S. Pat. No. 7,775,229, issued 2010 Aug. 17, to Ron Sy-Facunda, relates to technology of the present application which provides a collapsible canopy shelter having one or more side awnings that are pivotally coupled to the canopy frame. The canopy shelter for this has reinforced eaves for additional structural integrity, as well as at least one collapsible ventilation flap in the canopy cover that is capable of moving between a closed position and an open position to ventilate air from beneath the canopy cover as desired. Further, the collapsible canopy shelter comprises a canopy frame with a robust, spring-loaded pull latch, allowing the user to quickly and easily assemble and, collapse the shelter without risking injury.

U.S. Pat. No. 7,836,908, issued 2010 Nov. 23, to Ron Sy-Facunda, relates to technology of the present application which provides a canopy with an automatic roof structure having improved structural stability. The canopy comprises a plurality of vertical support posts connected by trusses. A plurality of roof support rods extend from the vertical support posts to a central hub. At least one of the roof support rods has a cantilever support extending from the associated slide or thereabouts to a pivot on the roof support rod. The canopy also comprises central truss supports and stubs extending from the connection of the lateral trusses to the central hub. The canopy has an expanded, open configuration and a collapsed, closed configuration.

U.S. Pat. No. 8,215,326, issued 2012 Jul. 10, to Bumjun Park, outlines a collapsible shelter assembly which includes plurality of legs with each of the legs having an upper, a lower end and an axis. A truss system links each pair of legs together and defines a perimeter. Rods are adapted for supporting a cover and brackets are adapted for attaching the rods to the legs. Each of the brackets has a base adapted for attachment to the upper end one of the legs and a coupler mounted to the base for attaching one of the rods. Each bracket is configured so that at least one of the base and the coupler is rotatable relative to the leg axis.

U.S. Pat. No. 8,220,476, issued 2012 Jul. 17, to Jeffry L. VanElverdinghe, outlines a frame structure comprising a plurality of leg members, a plurality of top-corner fittings, a plurality of slide fittings and a plurality of flexible-pole members. Each leg member comprises a first end and a second end. A top-corner fitting is attached to the first end of each leg member. A slide fitting is coupled to each leg member and is adjustably movable along a length of the leg member between the first end and the second end of the leg member.

U.S. Pat. No. 8,220,477, issued 2012 Jul. 17, to Lindy Park, refers to a collapsible canopy frame having an improved roof and support structure. A collapsible canopy frame according to one embodiment includes a plurality of side poles; a plurality of edge scissor assemblies coupling adjacent side poles of the plurality of side poles to one another; a center pole for supporting a covering; a plurality of center pole ribs each coupling the center pole to a respective side pole of the plurality of side poles; and a plurality of center scissor assemblies coupling the plurality of edge scissor assemblies to the center pole.

U.S. Pat. No. 8,544,489, issued 2013 Oct. 1, to Kwan Jun Choi, refers to a collapsible tent structure which includes a plurality of poles coupled with a plurality of linkages. The tent structure also includes a plurality of rods where each rod is pivotally coupled to each pole on one end and pivotally coupled to a hub on an opposite end. A plurality of struts are further included in the tent structure and each strut is pivotally coupled to each rod on one end and pivotally coupled to each pole on an opposite end, and a locking mechanism is coupled to each of the rods.

U.S. Pat. No. 8,616,226, issued 2013 Dec. 31, to Oliver Ma, refers to a shelter that includes a slider and a strut mechanism mounted on support posts of the shelter that automatically actuate and extend from the side of the support posts when the shelter is expanded from its collapsed state. The strut mechanism provides support for an eave that extends outside from all or a portion of the perimeter of the shelter defined by the corners of the support posts. An automatic hard-stop mechanism is incorporated into the support posts that prevent the eave sliders and strut mechanisms from becoming over-extended.

U.S. Pat. No. 8,701,692, issued 2014 Apr. 22, to Allen Holland, demonstrates a collapsible shelter which includes an improved attachment of the roof poles to the legs. A shelter frame has a leg at each corner. Each leg may have an angled top edge or surface. A scissor assembly attaches adjacent legs to each other. An offset link pivotally attaches the roof poles to the legs, adjacent to the top of each leg. The roof poles can be rigidly attached to the offset link. Extension poles are attached to the roof poles with a bungee or similar elastic element.

U.S. Pat. No. 8,978,680, issued 2015 Mar. 17, to Matt Kayser, demonstrates an erectable canopy framework comprising a base frame and a roof frame. The roof frame is operative to support a canopy above the base frame and is removably mountable to the base frame. The base frame includes a plurality of upright support members, a plurality of cross members, each interconnecting adjacent upright support members, and a plurality of mounts disposed on the upright support members.

U.S. Pat. No. 9,103,138, issued 2015 Aug. 11, to Jack B. Lovley, II, demonstrates a collapsible canopy structure includes one or more eaves, one or more fixed eave mounts, one or more sliding eave mounts and one or more vertical poles. Each of the vertical poles has a top end and a bottom end. Each of the vertical poles is connected by at least one of the one or more eaves.

U.S. Pat. No. 9,279,269, issued 2016 Mar. 8, to Jack B. Lovley, II, demonstrates a canopy shelter bracket for increased structural integrity. The canopy shelter bracket can include an inner portion, an intermediate portion, a first outer portion, and a second outer portion integrally connected to form a generally "F" shape or an "S" shape. The inner portion, first outer portion, and/or the second outer portion can include holes for receiving a fastener therethrough to fasten the brackets to cross members. A single fastener can be used to fasten multiple cross members to the bracket. The first and/or second outer portions can additionally serve to space apart a first cross member from a second cross member.

U.S. Pat. No. 9,528,292, issued 2016 Dec. 27, to Jack B. Lovley II, defines a canopy includes a frame assembly having a perimeter frame portion, a central frame portion and multiple legs. The frame assembly also includes one or more overhang frame portions, each of which can include a main overhang frame member and a strut. Each overhang frame portion can extend diagonally from the associated corner of the frame assembly. The canopy also includes a cover, which can be a fabric or flexible material cover capable of collapsing along with the preferably collapsible frame assembly.

U.S. Pat. No. D365,884, issued 1996 Jan. 2, to Ronald N. Dennis, depicts an ornamental design for a cloth-covered canopy.

U.S. Pat. No. D445,916, issued 2001 Jul. 31, to Nicholas Mark Reginald Pritchard, depicts an ornamental design for a portable shelter structure.

U.S. Publication No. 20070240748, published 2007 Oct. 18, by Sang-Jin Bae, reveals a canopy includes a plurality of height-adjustable support frames including upper and lower frames; a bottom fixture inserted/fixed in each lower frame; a fixed two-point connection member fixed to each upper frame; a height-adjustable movable two-point connection member installed to each upper frame; three-point connection members positioned between the upper frames respectively; upper and lower four-point connection members positioned in the middle of the support frames respectively and having a vertically-installed anti-drooping frame; and pivoting frames whose both ends are connected to each connection member and whose center portion is hinged pivotally.

U.S. Publication No. 20160168874, published 2016 Jun. 16, by Jack B. Lovley, II, reveals a collapsible canopy has a collapsible frame and a canopy cover supported by the collapsible frame. In some configurations, the frame includes telescopic legs having three or more stages. An automatic lock release is carried by one of the legs and automatically releases a lock between two other of the legs. A relative inner leg can include a cap having a resilient portion that contacts an inner surface of a relative outer leg to increase a lateral rigidity of the leg assembly. At least one of the eave cross members can have an end portion having an abutting extension that contacts an adjacent cross member to limit lateral deflection of the eave. The abutting extension can be positioned between eave cross members that incorporate a bracket for supporting a center support that extends from the eave toward a center or interior of the canopy.

DISADVANTAGES OF THE PRIOR ART

The prior art have failed to solve many problems associated with such portable popups, as follows:

1) No prior art mention or disclose any portable popup, having
   four multi-function latch-pulley-handles 113.
   Therefore, the prior art of portable popup:
   a) Can not be used as a latch,
      to bundle the tick-preventing multi-function-latch-pulley-handle and multi-function-latch-pulley-wheel popup when collapsed for easy storage
      (see FIG. 10 and FIG. 14);
   b) Can not be used as a handle,
      to tow and lift the tick-preventing multi-function-latch-pulley-handle and multi-function-latch-pulley-wheel popup
      (see FIG. 15);
   c) Can not be used as a handle,
      to easily deploy the tick-preventing multi-function-latch-pulley-handle and multi-function-latch-pulley-wheel popup
      (see FIG. 9); and
   d) Can not be used as a pulley,
      to be used with a cable 131 to secure popup cover 135 to the tick-preventing multi-function-latch-pulley-handle and multi-function-latch-pulley-wheel popup
   (see FIG. 2A, FIG. 16A, FIG. 16B, FIG. 16C, and FIG. 16D).
   For example:
      One can not sew first cable end 132 to popup cover 135
      (FIG. 2A),
      One can not hook cable 131 on multi-function latch-pulley-wheel 127
      (FIG. 16A),
      One can not hook second cable end 133 on carabiner 134
      (FIGS. 16B and 16C),
      One can not pull on cable 131, and
      One can not hook carabiner 134 on multi-function latch-pulley-handle 113
      (FIG. 16D).
2) No prior art mention or disclose any portable popup, having
   four multi-function post-centering water-discharging tick-preventing braces 116.
   Therefore, the prior art of portable popup:
   a) Can not center four lower octagonal posts 121 within four upper octagonal posts 115,
      to make assembly of the tick-preventing multi-function-latch-pulley-handle and multi-function-latch-pulley-wheel popup easier
      (see FIG. 13);
   b) Can not center four lower octagonal posts 121 within four upper octagonal posts 115,
      to cause less friction when adjusting height of the tick-preventing multi-function-latch-pulley-handle and multi-function-latch-pulley-wheel popup
      (see FIG. 13);
   c) Can not help prevent ticks and other bugs from entering four upper octagonal posts 115,
      to keep pets and occupants safe
      (see FIG. 13); and
   d) Can not help with water drainage,
      to prevent rusting
      (see FIG. 13).
3) No prior art mention or disclose any portable popup, having
   tick-preventing downward teeth 117.
   Therefore, the prior art of portable popup:
   a) Can not prevent ticks and other pests from entering four upper octagonal posts 115,
      to keep pets and other occupants safe
      (see FIG. 13);
   b) Can not help with water drainage,
      to prevent rusting
      (see FIG. 13);
   c) Can not help to center four lower octagonal posts 121 inside four upper octagonal posts 115,
      to help keep the lower post from scratching the upper posts
      (see FIG. 13); and
   d) Can not be used to buffer four lower octagonal posts 121 within four upper octagonal posts 115,
      to help making adjusting height of easier
      (see FIG. 13).
4) No prior art mention or disclose any portable popup, having
   water-discharging recesses 118.
   Therefore, the prior art of portable popup:
   a) Can not help with water drainage,
      to prevent rusting
      (see FIG. 13);
   b) Can not provide buffer between four lower octagonal posts 121 and four upper octagonal posts 115,
      to make adjusting the tick-preventing multi-function-latch-pulley-handle and multi-function-latch-pulley-wheel popup easier
      (see FIG. 13);
   c) Can not help prevent ticks and other pests from getting into four lower octagonal posts 121 and four upper octagonal posts 115,
      to keep pets and other occupants safe
      (see FIG. 13); and
   d) Can not help center four lower octagonal posts 121 inside four upper octagonal posts 115,
      to keep four lower octagonal posts 121 from scratching four upper octagonal posts 115
      (see FIG. 13).
5) No prior art mention or disclose any portable popup, having
   a multi-function latch-pulley-wheel 127.
   Therefore, the prior art of portable popup:
   a) Can not be used as a latch,
      to secure cable thereon to secure popup cover 135, (see FIG. 17A, FIG. 17B, FIG. 17C, FIG. 18A, FIG. 18B, and FIG. 18C);

b) Can not be used to configure the tick-preventing multi-function-latch-pulley-handle and multi-function-latch-pulley-wheel popup,
to utilize a variety of canopy options
(see FIG. 17A, FIG. 17B, FIG. 17C, FIG. 18A, FIG. 18B, and FIG. 18C);

c) Can not be used as a pulley for cable,
to secure cable thereon to secure popup cover 135
(see FIG. 17A, FIG. 17B, FIG. 17C, FIG. 18A, FIG. 18B, and FIG. 18C);

d) Can not be used together with latch-pulley handle 113,
to reduce forces needed to pull on cable 131 and carabiner 134 to stretch and secure popup cover 135 to cover popup top, popup side and/or popup post
(see FIG. 17A, FIG. 17B, FIG. 17C, FIG. 18A, FIG. 18B, and FIG. 18C);

e) Can not be used with cable to tie four lower octagonal posts 121 together,
to create a stronger structure to prevent bending and twisting
(see FIG. 22); and f) Can not be used as a wheel,
to roll the tick-preventing multi-function-latch-pulley-handle and multi-function-latch-pulley-wheel popup on the ground for transportation and storage
(see FIG. 15).

6) No prior art mention or disclose any portable popup, having
four automatic rounded-head see-saw post locks 111.
Therefore, the prior art of portable popup:

a) Can not quickly and easily lock four lower corner intersectors 110 to four upper octagonal posts 115,
to raise and lower the tick-preventing multi-function-latch-pulley-handle and multi-function-latch-pulley-wheel popup
(see FIG. 6 and FIG. 7);

b) Can not conveniently and automatically snap-lock into post-height-adjusting tapered holes 120,
to make adjusting the tick-preventing multi-function-latch-pulley-handle and multi-function-latch-pulley-wheel popup easier
(see FIG. 6 and FIG. 7);

c) Can not easily and automatically slip into post-height-adjusting tapered holes 120,
to make adjusting height of the tick-preventing multi-function-latch-pulley-handle and multi-function-latch-pulley-wheel popup easier
(see FIG. 6 and FIG. 7); and d) Can not conveniently lock the tick-preventing multi-function-latch-pulley-handle and multi-function-latch-pulley-wheel popup,
to keep the tick-preventing multi-function-latch-pulley-handle and multi-function-latch-pulley-wheel popup from collapsing.

7) No prior art mention or disclose any portable popup, having
four see-saw-post-lock springs 112.
Therefore, the prior art of portable popup:

a) Can not automatically pivot four automatic rounded-head see-saw post locks 111 into post-height-adjusting tapered holes 120,
to help aligning four lower corner intersectors 110 to post-height-adjusting tapered holes 120
(see FIG. 6 and FIG. 7);

b) Can not easily pivot four automatic rounded-head see-saw post locks 111 in and out of post-height-adjusting tapered holes 120,
to quickly adjust height of the tick-preventing multi-function-latch-pulley-handle and multi-function-latch-pulley-wheel popup;

c) Can not easily and automatically and springidly slip into post-height adjusting tapered holes 120,
to make adjusting height of the tick-preventing multi-function-latch-pulley-handle and multi-function-latch-pulley-wheel popup easier
(see FIG. 6 and FIG. 7); and d) Can not quickly and easily compress-lock four lower corner intersectors 110 to four upper octagonal posts 115,
to prevent the tick-preventing multi-function-latch-pulley-handle and multi-function-latch-pulley-wheel popup from collapsing
(see FIG. 6 and FIG. 7).

8) No prior art mention or disclose any portable popup, having
post-height-adjusting tapered holes 120.
Therefore, the prior art of portable popup:

a) Can not automatically slip four automatic rounded-head see-saw post locks 111 into post-height-adjusting tapered holes 120,
to lock four upper octagonal posts 115 to four lower octagonal posts 121
(see FIG. 6 and FIG. 7);

b) Can not automatically slip four automatic rounded-head see-saw post locks 111 into post-height-adjusting tapered holes 120,
to help make adjusting the tick-preventing multi-function-latch-pulley-handle and multi-function-latch-pulley-wheel popup easier;

c) Can not help prevent water from getting inside four upper octagonal posts 115,
to prevent rusting; and d) Can not provide multiple locations of locking for four automatic rounded-head see-saw post locks 111,
to give multiple configuration options to the tick-preventing multi-function-latch-pulley-handle and multi-function-latch-pulley-wheel popup.

OBJECTS AND ADVANTAGES OF THE INVENTION

The present invention substantially departs from the conventional concepts and designs of the prior art. In doing so, the present invention provides a tick-preventing multi-function-latch-pulley-handle and multi-function-latch-pulley-wheel popup (having: 1) Post-centering braces, 2) Water-discharging recesses, 3) Tick-preventing teeth, 4) Multi-function latch-pulley-handles, and 5) Multi-function latch-pulley-wheels) having many unique and significant features, functions, and advantages, which overcome all the disadvantages of the prior art, as follows:

1) It is an object of the new invention to provide a tick-preventing multi-function-latch-pulley-handle and multi-function-latch-pulley-wheel popup, having four multi-function latch-pulley-handles 113.
Therefore, the tick-preventing multi-function-latch-pulley-handle and multi-function-latch-pulley-wheel popup:

a) Can be used as a latch,
to bundle the tick-preventing multi-function-latch-pulley-handle and multi-function-latch-pulley-wheel popup when collapsed for easy storage
(see FIG. 10 and FIG. 14);
b) Can be used as a handle,
to tow and lift the tick-preventing multi-function-latch-pulley-handle and multi-function-latch-pulley-wheel popup
(see FIG. 15);
c) Can be used as a handle,
to easily deploy the tick-preventing multi-function-latch-pulley-handle and multi-function-latch-pulley-wheel popup
(see FIG. 9); and
d) Can be used as a pulley,
to be used with a cable 131 to secure popup cover 135 to the tick-preventing multi-function-latch-pulley-handle and multi-function-latch-pulley-wheel popup
(see FIG. 2A, FIG. 16A, FIG. 16B, FIG. 16C, and FIG. 16D).

For example:
One can not sew first cable end 132 to popup cover 135
(FIG. 2A),
One can not hook cable 131 on multi-function latch-pulley-wheel 127
(FIG. 16A),
One can not hook second cable end 133 on carabiner 134
(FIGS. 16B and 16C),
One can not pull on cable 131, and
One can not hook carabiner 134 on multi-function latch-pulley-handle 113
(FIG. 16D).

2) It is another object of the new invention to provide a tick-preventing multi-function-latch-pulley-handle and multi-function-latch-pulley-wheel popup, having four multi-function post-centering water-discharging tick-preventing braces 116. Therefore, the tick-preventing multi-function-latch-pulley-handle and multi-function-latch-pulley-wheel popup:
a) Can center four lower octagonal posts 121 within four upper octagonal posts 115,
to make assembly of the tick-preventing multi-function-latch-pulley-handle and multi-function-latch-pulley-wheel popup easier
(see FIG. 13);
b) Can center four lower octagonal posts 121 within four upper octagonal posts 115,
to cause less friction when adjusting height of the tick-preventing multi-function-latch-pulley-handle and multi-function-latch-pulley-wheel popup
(see FIG. 13);
c) Can help prevent ticks and other bugs from entering four upper octagonal posts 115,
to keep pets and occupants safe
(see FIG. 13); and
d) Can help with water drainage,
to prevent rusting
(see FIG. 13).

3) It is still another object of the new invention to provide a tick-preventing multi-function-latch-pulley-handle and multi-function-latch-pulley-wheel popup, having tick-preventing downward teeth 117.
Therefore, the tick-preventing multi-function-latch-pulley-handle and multi-function-latch-pulley-wheel popup:
a) Can prevent ticks and other pests from entering four upper octagonal posts 115,
to keep pets and other occupants safe
(see FIG. 13);
b) Can help with water drainage,
to prevent rusting
(see FIG. 13);
c) Can help to center four lower octagonal posts 121 inside four upper octagonal posts 115,
to help keep the lower post from scratching the upper posts
(see FIG. 13); and
d) Can be used to buffer four lower octagonal posts 121 within four upper octagonal posts 115,
to help making adjusting height of easier
(see FIG. 13).

4) It is a further object of the new invention to provide a tick-preventing multi-function-latch-pulley-handle and multi-function-latch-pulley-wheel popup, having water-discharging recesses 118.
Therefore, the tick-preventing multi-function-latch-pulley-handle and multi-function-latch-pulley-wheel popup:
a) Can help with water drainage,
to prevent rusting
(see FIG. 13);
b) Can provide buffer between four lower octagonal posts 121 and four upper octagonal posts 115,
to make adjusting the tick-preventing multi-function-latch-pulley-handle and multi-function-latch-pulley-wheel popup easier
(see FIG. 13);
c) Can help prevent ticks and other pests from getting into four lower octagonal posts 121 and four upper octagonal posts 115,
to keep pets and other occupants safe
(see FIG. 13); and
d) Can help center four lower octagonal posts 121 inside four upper octagonal posts 115,
to keep four lower octagonal posts 121 from scratching four upper octagonal posts 115
(see FIG. 13).

5) It is an even further object of the new invention to provide a tick-preventing multi-function-latch-pulley-handle and multi-function-latch-pulley-wheel popup, having a multi-function latch-pulley-wheel 127.
Therefore, the tick-preventing multi-function-latch-pulley-handle and multi-function-latch-pulley-wheel popup:
a) Can be used a latch,
to secure cable thereon to secure popup cover 135,
(see FIG. 17A, FIG. 17B, FIG. 17C, FIG. 18A, FIG. 18B, and FIG. 18C);
b) Can be used to configure the tick-preventing multi-function-latch-pulley-handle and multi-function-latch-pulley-wheel popup,
to utilize a variety of canopy options
(see FIG. 17A, FIG. 17B, FIG. 17C, FIG. 18A, FIG. 18B, and FIG. 18C);
c) Can be used as a pulley for cable,
to secure cable thereon to secure popup cover 135
(see FIG. 17A, FIG. 17B, FIG. 17C, FIG. 18A, FIG. 18B, and FIG. 18C);

d) Can be used together with latch-pulley handle 113,
to reduce forces needed to pull on cable 131 and carabiner 134 to stretch and secure popup cover 135 to cover popup top, popup side and/or popup post
(see FIG. 17A, FIG. 17B, FIG. 17C, FIG. 18A, FIG. 18B, and FIG. 18C);

e) Can be used with cable to tie four lower octagonal posts 121 together,
to create a stronger structure to prevent bending and twisting
(see FIG. 22); and f) Can be used as a wheel,
to roll the tick-preventing multi-function-latch-pulley-handle and multi-function-latch-pulley-wheel popup on the ground for transportation and storage
(see FIG. 15).

6) It is still another object of the new invention to provide a tick-preventing multi-function-latch-pulley-handle and multi-function-latch-pulley-wheel popup, having four automatic rounded-head see-saw post locks 111.
Therefore, the tick-preventing multi-function-latch-pulley-handle and multi-function-latch-pulley-wheel popup:

a) Can quickly and easily lock four lower corner intersectors 110 to four upper octagonal posts 115,
to raise and lower the tick-preventing multi-function-latch-pulley-handle and multi-function-latch-pulley-wheel popup
(see FIG. 6 and FIG. 7);

b) Can conveniently and automatically snap-lock into post-height-adjusting tapered holes 120,
to make adjusting the tick-preventing multi-function-latch-pulley-handle and multi-function-latch-pulley-wheel popup easier
(see FIG. 6 and FIG. 7);

c) Can easily and automatically slip into post-height-adjusting tapered holes 120,
to make adjusting height of the tick-preventing multi-function-latch-pulley-handle and multi-function-latch-pulley-wheel popup easier
(see FIG. 6 and FIG. 7); and d) Can conveniently lock the tick-preventing multi-function-latch-pulley handle and multi-function-latch-pulley-wheel popup,
to keep the tick-preventing multi-function-latch-pulley-handle and multi-function-latch-pulley-wheel popup from collapsing.

7) It is yet another object of the new invention to provide a tick-preventing multi-function-latch-pulley-handle and multi-function-latch-pulley-wheel popup, having four see-saw-post-lock springs 112.
Therefore, the tick-preventing multi-function-latch-pulley-handle and multi-function-latch-pulley-wheel popup:

a) Can automatically pivot four automatic rounded-head see-saw post locks 111 into post-height-adjusting tapered holes 120,
to help aligning four lower corner intersectors 110 to post-height-adjusting tapered holes 120
(see FIG. 6 and FIG. 7);

b) Can easily pivot four automatic rounded-head see-saw post locks 111 in and out of post-height-adjusting tapered holes 120,
to quickly adjust height of the tick-preventing multi-function-latch-pulley-handle and multi-function-latch-pulley-wheel popup;

c) Can easily and automatically and springidly slip into post-height adjusting tapered holes 120,
to make adjusting height of the tick-preventing multi-function-latch-pulley-handle and multi-function-latch-pulley-wheel popup easier
(see FIG. 6 and FIG. 7); and d) Can quickly and easily compress-lock four lower corner intersectors 110 to four upper octagonal posts 115,
to prevent the tick-preventing multi-function-latch-pulley-handle and multi-function-latch-pulley-wheel popup from collapsing
(see FIG. 6 and FIG. 7).

8) It is still yet another object of the new invention to provide a tick-preventing multi-function-latch-pulley-handle and multi-function-latch-pulley-wheel popup, having post-height-adjusting tapered holes 120.
Therefore, the tick-preventing multi-function-latch-pulley-handle and multi-function-latch-pulley-wheel popup:

a) Can automatically slip four automatic rounded-head see-saw post locks 111 into post-height-adjusting tapered holes 120,
to lock four upper octagonal posts 115 to four lower octagonal posts 121
(see FIG. 6 and FIG. 7);

b) Can automatically slip four automatic rounded-head see-saw post locks 111 into post-height-adjusting tapered holes 120,
to help make adjusting the tick-preventing multi-function-latch-pulley-handle and multi-function-latch-pulley-wheel popup easier;

c) Can help prevent water from getting inside four upper octagonal posts 115,
to prevent rusting; and d) Can provide multiple locations of locking for four automatic rounded-head see-saw post locks 111,
to give multiple configuration options to the tick-preventing multi-function-latch-pulley-handle and multi-function-latch-pulley-wheel popup.

Other objects and advantages of the present invention will become apparent from a consideration of the accompanying drawings and ensuing description.

SUMMARY OF THE INVENTION

A tick-preventing multi-function-latch-pulley-handle and multi-function-latch-pulley-wheel popup comprises four-way circular roof intersector, foldable roof trusses, foldable side trusses, four upper corner intersectors and four lower corner intersectors each being able to be adjusted up and down, four automatic rounded-head see-saw post locks and four see-saw-post-lock springs respectively attached to the four lower corner intersectors for locking and unlocking upper corner intersectors, four multi-function latch-pulley-handles respectively and pivotably attached to the four upper corner intersectors for functioning as latches to wrap on the side trusses to lock the popup when folded and for also functioning as pulleys to wrap cables thereon and for also functioning as handles to unfold the popup, four upper octagonal posts, four multi-function post-centering water-discharging tick-preventing braces respectively attached to the four upper octagonal posts, tick-preventing downward teeth and water-discharging recesses, respectively molded to the four multi-function post-centering water-discharging tick-preventing braces for preventing ticks from entering the popup posts and allowing water drainage to protect pets and other occupants, post-height-adjusting tapered holes respectively inserted into four lower octagonal posts, wheel chassis respectively attached to the four lower octagonal posts, and multi-function latch-pulley-wheel rotatably attached to the wheel chassis for functioning as latches to hook cables thereon and for also functioning as pulleys to wrap cables thereon to tension the popup canopy and for also functioning as wheels to roll the popup along the ground.

DETAILED DESCRIPTION OF THE INVENTION

Figure 1:
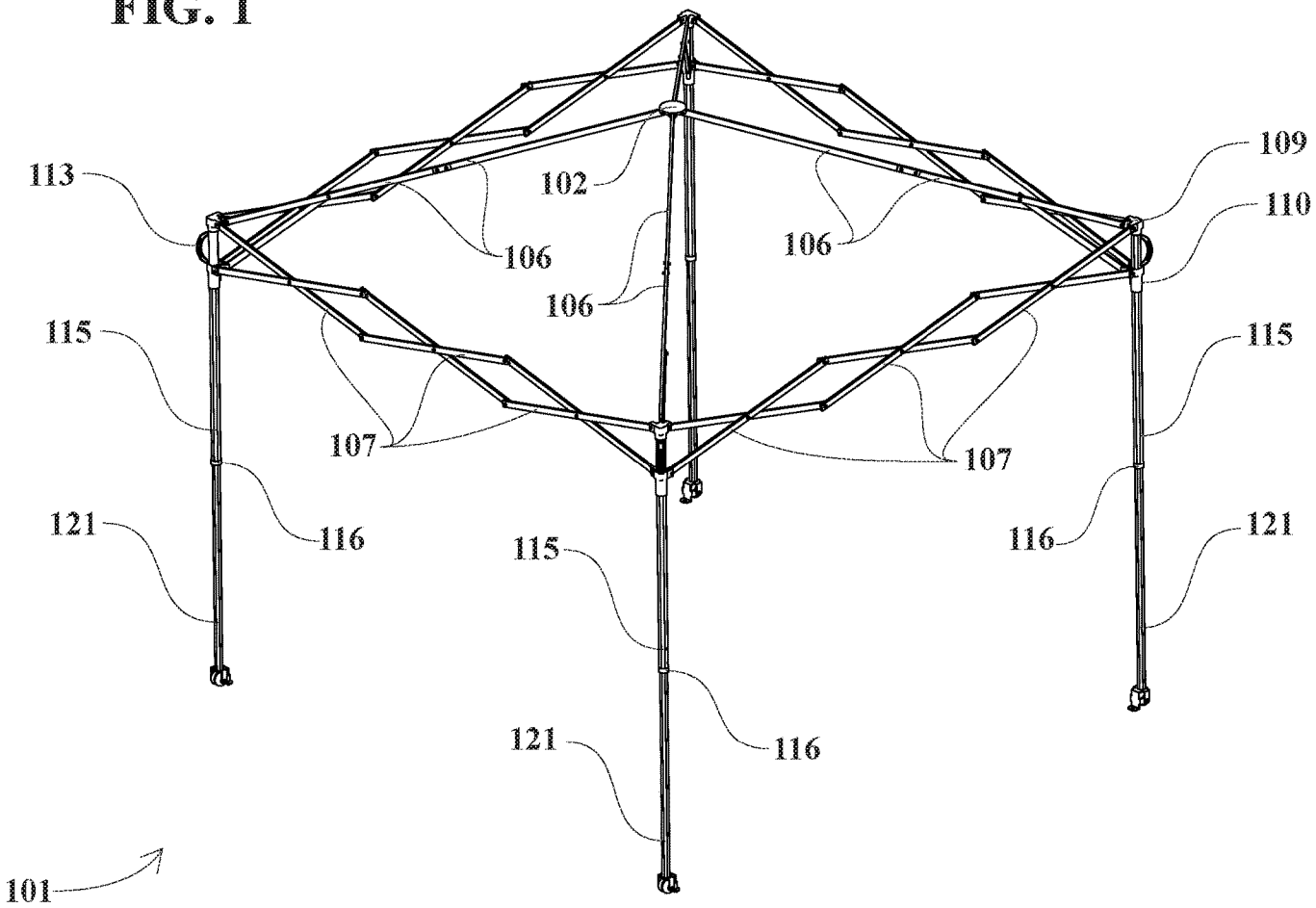
FIG. 1 illustrates a perspective view of the assembly of a tick-preventing multi-function-latch-pulley-handle multi-function-latch-pulley-wheel popup.
Figure 2A:
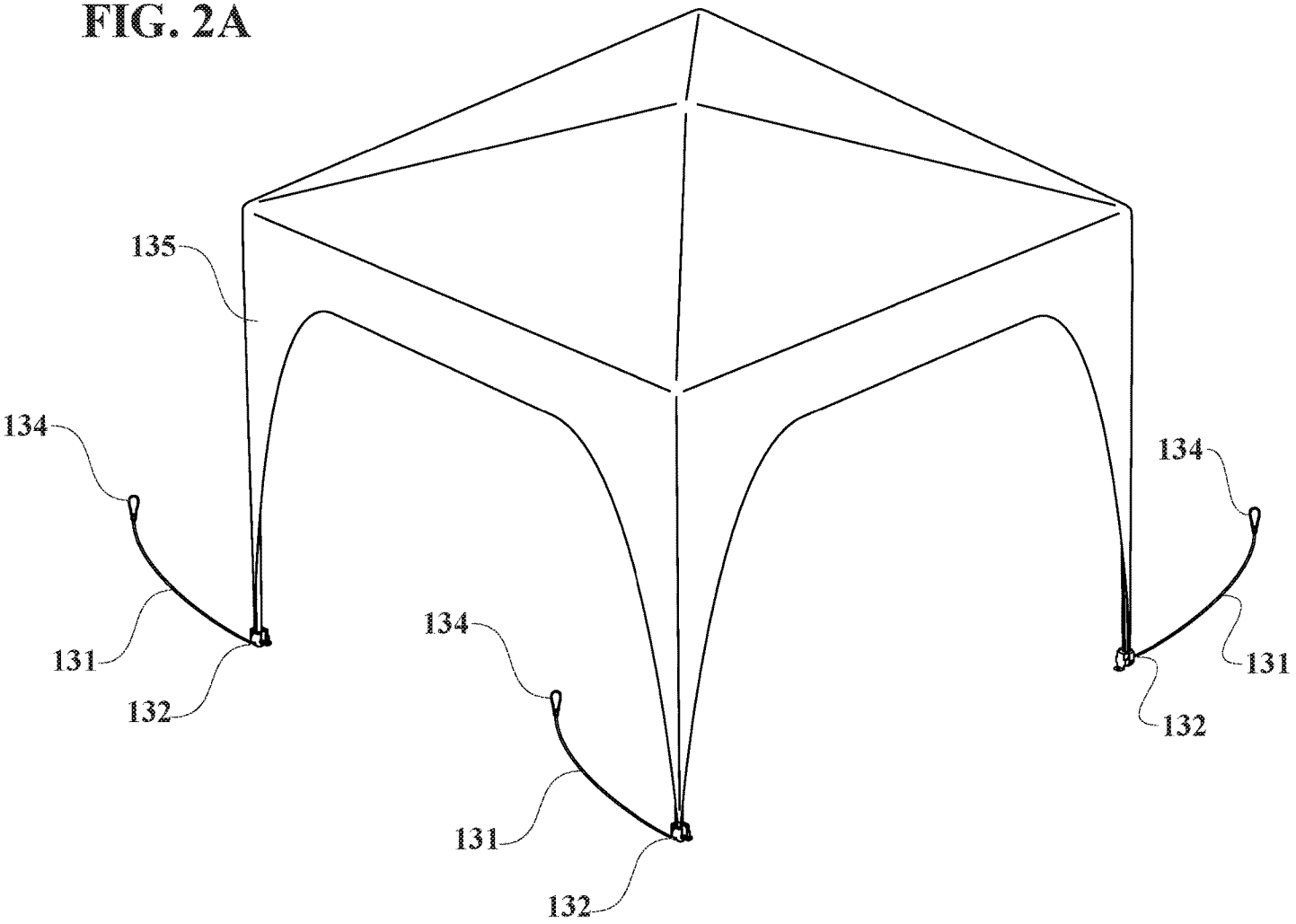
FIG. 2A to FIG. 2I illustrate perspective and side views of how a cable and a carabiner systems are used together with a multi-function latch-pulley-wheel and a multi-function latch-pulley-handle to attach a popup cover to the foldable frame of the tick-preventing multi-function-latch-pulley-handle multi-function-latch-pulley-wheel popup.
Figure 2B:
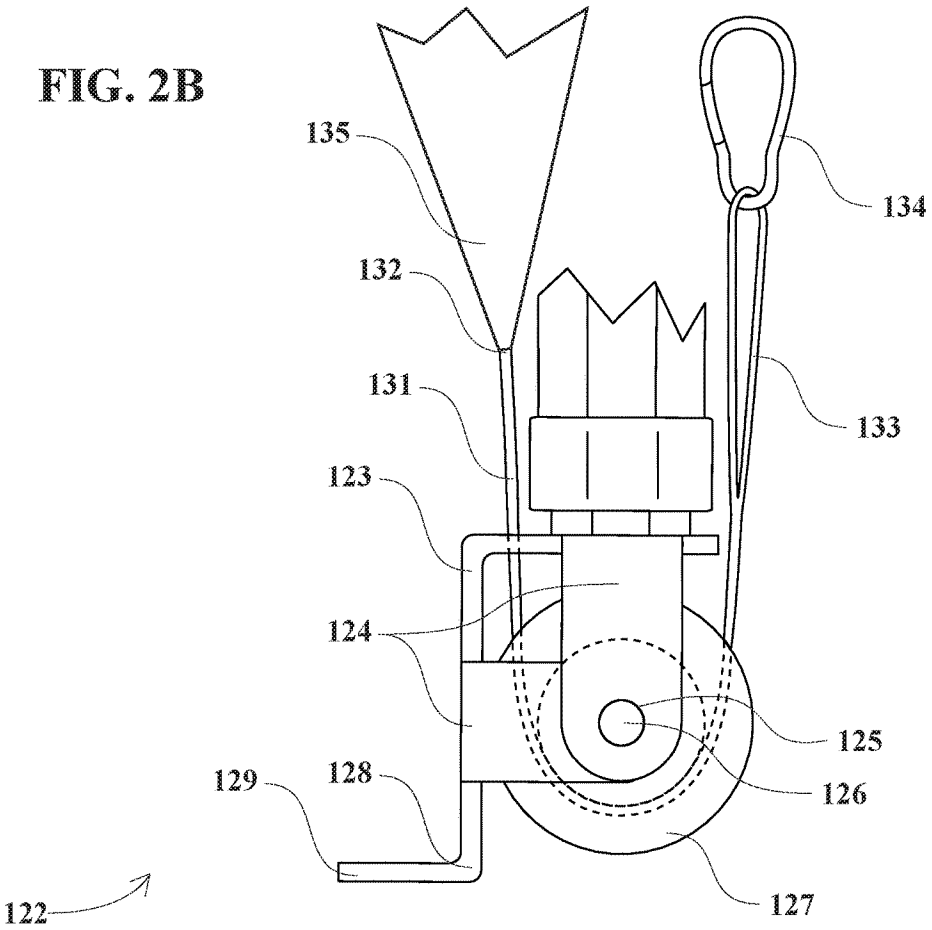
Figure 2D:
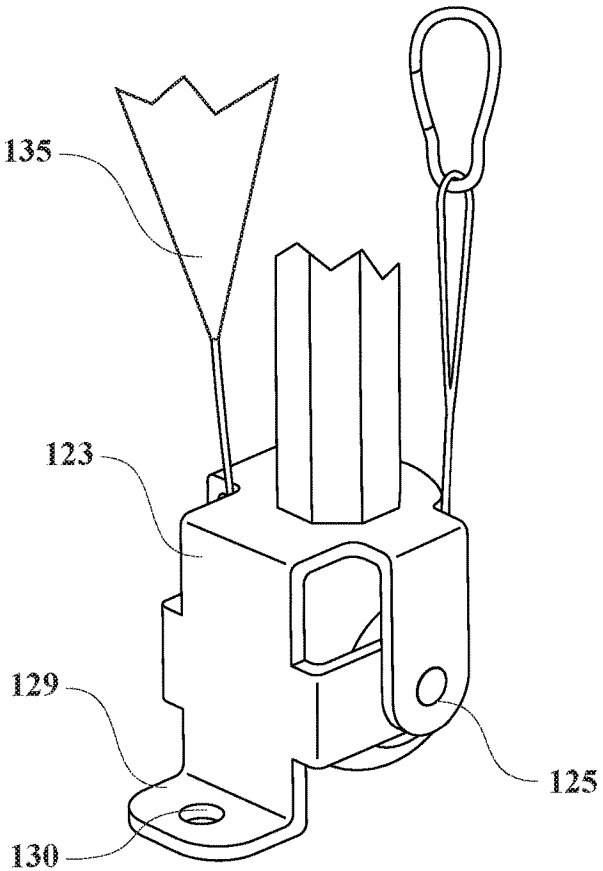
Figure 2C:
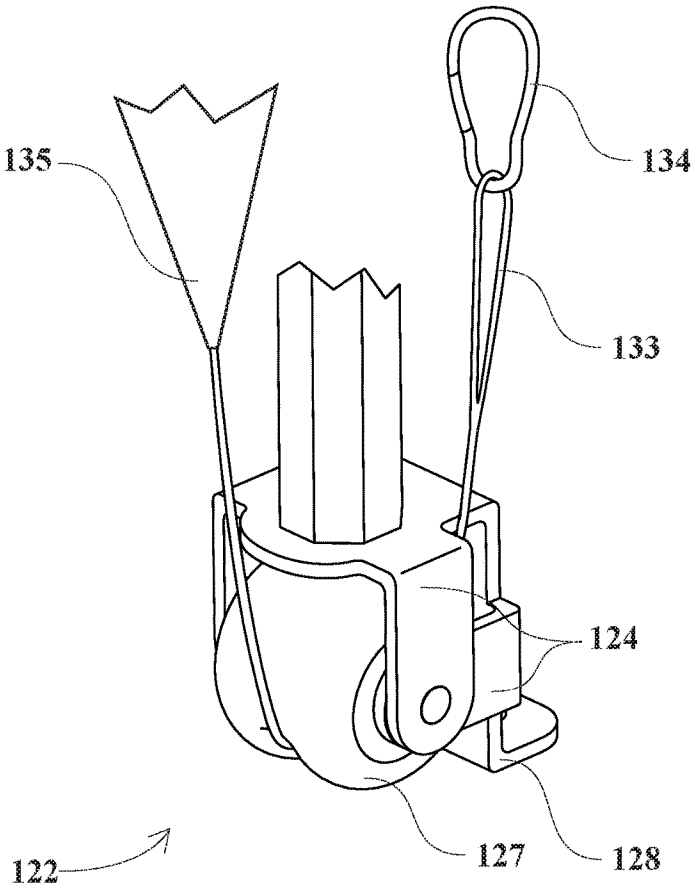
Figure 2E:
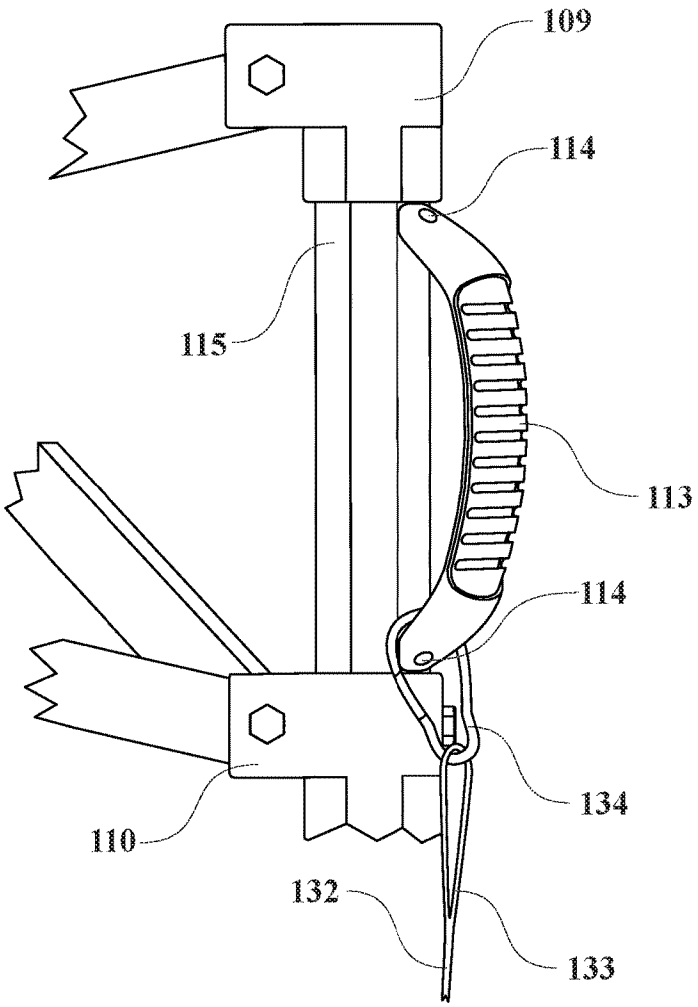
Figure 2G:
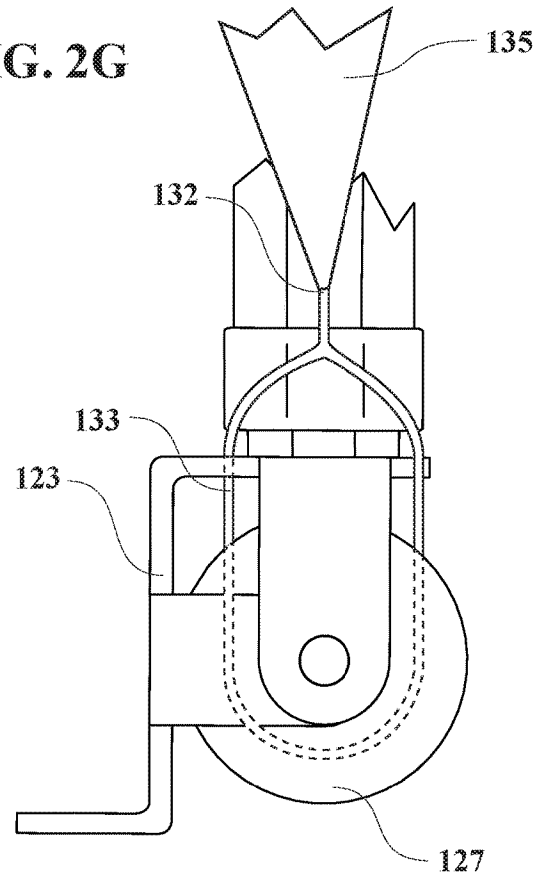
Figure 2F:
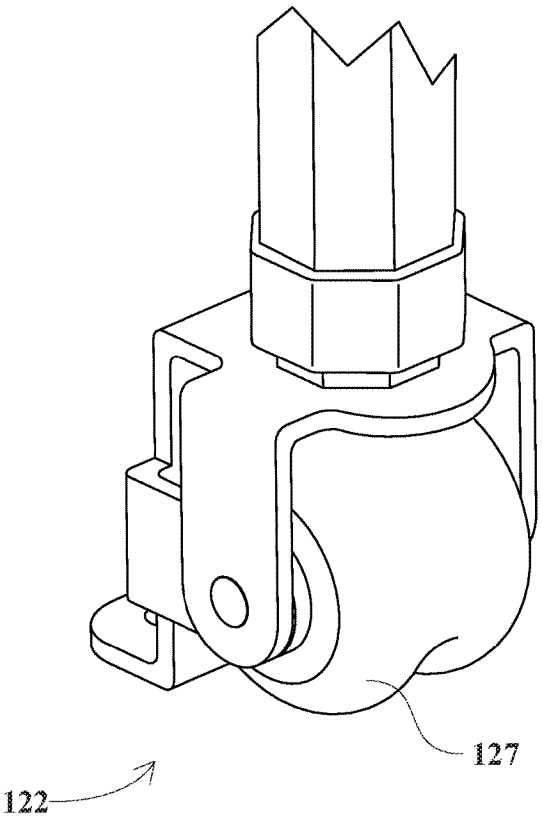
Figure 2I:
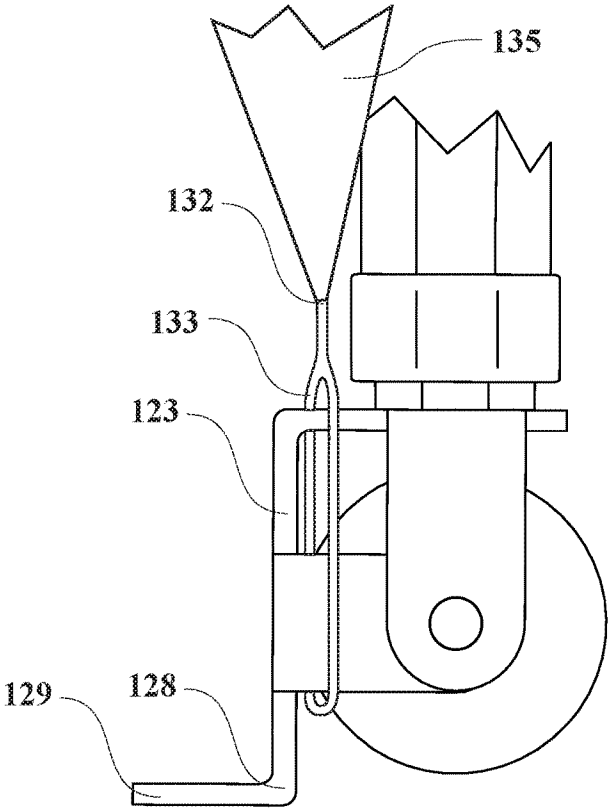
Figure 2H:
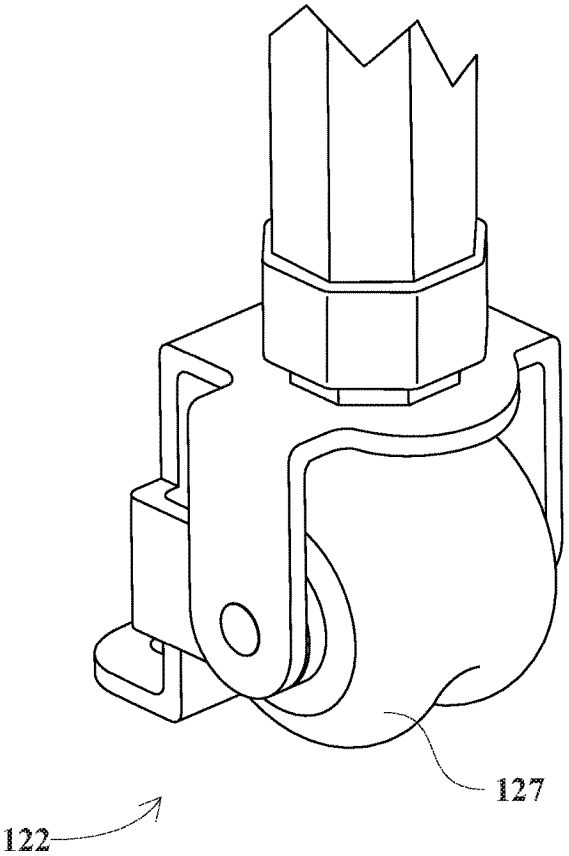
Figure 4:
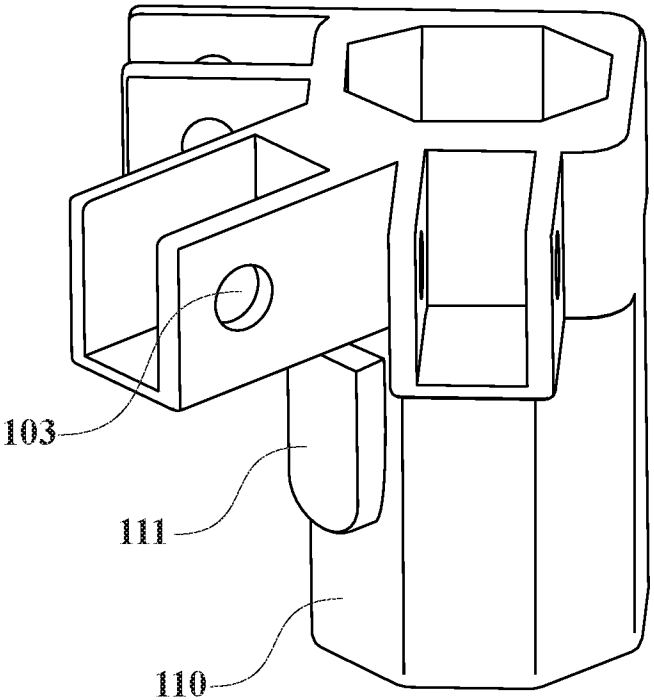
FIG. 3 to FIG. 4 illustrate perspective views of an upper corner intersector and a lower corner intersector.
Figure 3:
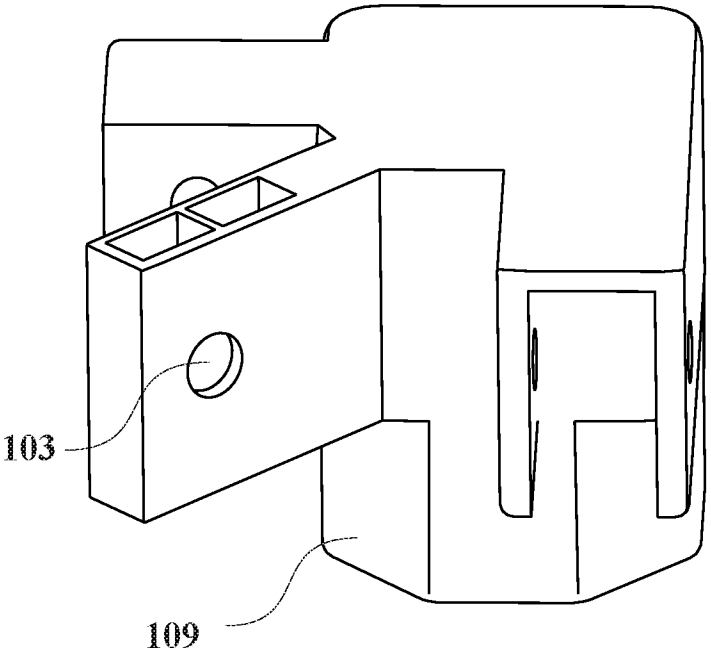
Figure 5A:
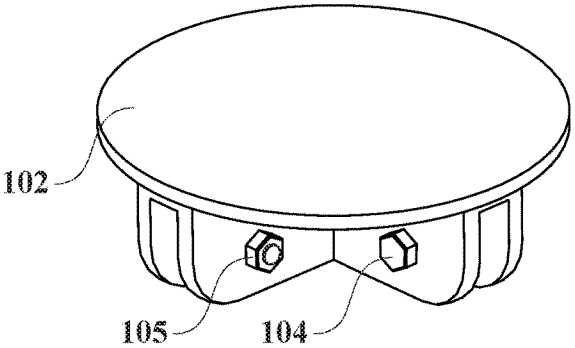
FIG. 5A to FIG. 5C illustrate perspective and side views of a four-way circular roof intersector.
Figure 5B:
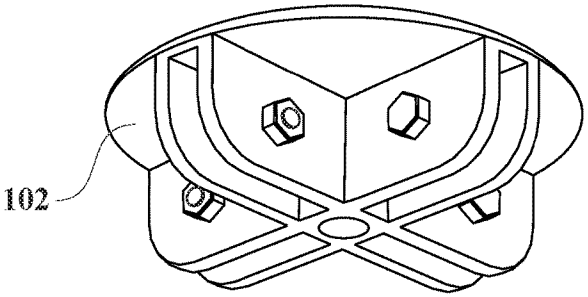
Figure 5C:
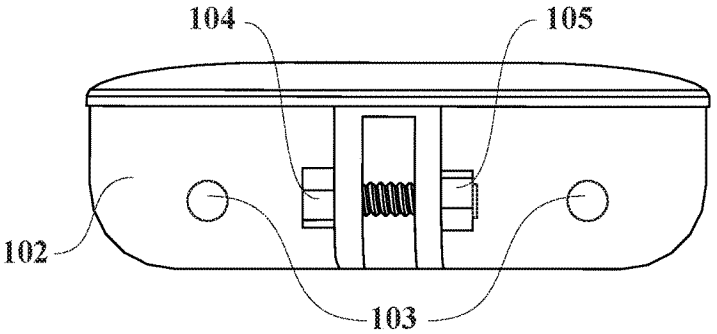

The tick-preventing multi-function-latch-pulley-handle multi-function-latch-pulley-wheel popup has:

1) Post-centering braces,
2) Water-discharging recesses,
3) Tick-preventing teeth,
4) Multi-function latch-pulley-handles, and
5) Multi-function latch-pulley-wheels.

Component

Referring to FIG. 1, FIG. 2A, FIG. 2B, FIG. 2C, FIG. 2D, FIG. 2E, FIG. 2F, FIG. 2G, FIG. 2H, FIG. 2I, FIG. 3, FIG. 4, FIG. 5A, FIG. 5B, FIG. 5C, FIG. 6, FIG. 7, FIG. 8, FIG. 9, FIG. 10, FIG. 11, FIG. 12, and FIG. 13, the tick-preventing multi-function-latch-pulley-handle multi-function-latch-pulley-wheel popup comprises:

1) Foldable-frame tick-preventing-brace multi-function-latch-pulley-handle system 101, comprising:
2) Four-way circular roof intersector 102,
3) Intersector holes 103,
4) Bolts 104,
5) Nuts 105,
6) Foldable roof trusses 106,
7) Foldable side trusses 107, 8) Truss holes 108,
9) Four upper corner intersectors 109,
10) Four lower corner intersectors 110,
11) Four automatic rounded-head see-saw post locks 111,
12) Four see-saw-post-lock springs 112,
13) Four multi-function latch-pulley-handles 113,
14) Handle rivets 114,
15) Four upper octagonal posts 115,
16) Four multi-function post-centering water-discharging tick-preventing braces 116,
17) Tick-preventing downward teeth 117,
18) Water-discharging recesses 118,
19) Four V-shaped post-locking springs 119,
20) Post-height-adjusting tapered holes 120, and
21) Four lower octagonal posts 121; and
22) Four multi-function-latch-pulley-wheel systems 122, each comprising:
23) Wheel chassis 123,
24) Wheel braces 124,
25) Wheel-axle holes 125,
26) Wheel axle 126,
27) Multi-function latch-pulley-wheel 127,
28) Post ankle 128,
29) Post foot 129, and
30) Stake hole 130.

Material

Referring to FIG. 1, FIG. 2A, FIG. 2B, FIG. 2C, FIG. 2D, FIG. 2E, FIG. 2F, FIG. 2G, FIG. 2H, FIG. 2I, FIG. 3, FIG. 4, FIG. 5A, FIG. 5B, FIG. 5C, FIG. 6, FIG. 7, FIG. 8, FIG. 9, FIG. 10, FIG. 11, FIG. 12, and FIG. 13:

1) Foldable-frame tick-preventing-brace multi-function-latch-pulley-handle system 101 is made of the combined materials of its components.
2) Four-way circular roof intersector 102 is made of plastic material.
3) Intersector holes 103 each are made of empty space.
4) Bolts 104 each are made of metallic material.
5) Nuts 105 each are made of metallic material.
6) Foldable roof trusses 106 each are made of metallic material.
7) Foldable side trusses 107 each are made of metallic material.
8) Truss holes 108 each are made of empty space.
9) Four upper corner intersectors 109 each are made of plastic material.
10) Four lower corner intersectors 110 each are made of plastic material.
11) Four automatic rounded-head see-saw post locks 111 each are made of plastic material.
12) Four see-saw-post-lock springs 112 each are made of metallic material.
13) Four multi-function latch-pulley-handles 113 each are made of rubber and/or nylon material(s).
14) Handle rivets 114 each are made of metallic material.
15) Four upper octagonal posts 115 each are made of metallic material.
16) Four multi-function post-centering water-discharging tick-preventing braces 116 each are made of plastic material.
17) Tick-preventing downward teeth 117 each are made of plastic material.
18) Water-discharging recesses 118 each are made of empty space.
19) Four V-shaped post-locking springs 119 each are made of metallic material.
20) Post-height-adjusting tapered holes 120 each are made of empty space.
21) Four lower octagonal posts 121 each are made of metallic material.
22) Four multi-function-latch-pulley-wheel systems 122 each are made of the combined materials of its components.
23) Wheel chassis 123 is made of metallic material.
24) Wheel braces 124 each are made of metallic material.
25) Wheel-axle holes 125 each are made of empty space.
26) Wheel axle 126 is made of metallic material.
27) Multi-function latch-pulley-wheel 127 is made of plastic, plasticized, metallic, or equivalent material(s).
28) Post ankle 128 is made of metallic material.
29) Post foot 129 is made of metallic material.
30) Stake hole 130 is made of empty space.

Shape

Referring to FIG. 1, FIG. 2A, FIG. 2B, FIG. 2C, FIG. 2D, FIG. 2E, FIG. 2F, FIG. 2G, FIG. 2H, FIG. 2I, FIG. 3, FIG. 4, FIG. 5A, FIG. 5B, FIG. 5C, FIG. 6, FIG. 7, FIG. 8, FIG. 9, FIG. 10, FIG. 11, FIG. 12, and FIG. 13:

1) Foldable-frame tick-preventing-brace multi-function-latch-pulley-handle system 101 has the combined shapes of its components.
2) Four-way circular roof intersector 102 has a round shape with four U-shaped arms.
3) Intersector holes 103 each have a round shape.
4) Bolts 104 each have a bolt shape with a hexagon-shaped head.
5) Nuts 105 each have a hexagonal shape.
6) Foldable roof trusses 106 each have a rectangular-or-oval-tube shape.
7) Foldable side trusses 107 each have a rectangular-or-oval-tube shape.
8) Truss holes 108 each have a round shape.
9) Four upper corner intersectors 109 each have a hexagonal-tube shape with one closed end, one open end, and three U-shaped arms.
10) Four lower corner intersectors 110 each have a hexagonal-tube shape with two open ends and three U-shaped arms.
11) Four automatic rounded-head see-saw post locks 111 each have a rectangular-hook shape with a rounded head.
12) Four see-saw-post-lock springs 112 each have a spring shape.
13) Four multi-function latch-pulley-handles 113 each have a C shape.
14) Handle rivets 114 each have a rivet shape.
15) Four upper octagonal posts 115 each have a tube shape with an octagonal cross-section.
16) Four multi-function post-centering water-discharging tick-preventing braces 116 each have a ring shape with an octagonal cross-section.
17) Tick-preventing downward teeth 117 each have a zig-zag-tooth shape.
18) Water-discharging recesses 118 each have a C shape.
19) Four V-shaped post-locking springs 119 each have a V shape with a rounded end.
20) Post-height-adjusting tapered holes 120 each have a tapered round shape.
21) Four lower octagonal posts 121 each have a tube shape with an octagonal cross-section.
22) Four multi-function-latch-pulley-wheel systems 122 each have the combined shapes of its components.
23) Wheel chassis 123 has an L shape.
24) Wheel braces 124 each have a J shape.
25) Wheel-axle holes 125 each have a round shape.
26) Wheel axle 126 has a cylindrical shape.

27) Multi-function latch-pulley-wheel 127 has a circular-wheel-or-pulley shape.
28) Post ankle 128 has a rectangular shape.
29) Post foot 129 has a rectangular shape with a rounded edge.
30) Stake hole 130 has a round shape.

Connection

Referring to FIG. 1, FIG. 2A, FIG. 2B, FIG. 2C, FIG. 2D, FIG. 2E, FIG. 2F, FIG. 2G, FIG. 2H, FIG. 2I, FIG. 3, FIG. 4, FIG. 5A, FIG. 5B, FIG. 5C, FIG. 6, FIG. 7, FIG. 8, FIG. 9, FIG. 10, FIG. 11, FIG. 12, and FIG. 13:

1) Foldable-frame tick-preventing-brace multi-function-latch-pulley-handle system 101 has the combined connections of its components.
2) Four-way circular roof intersector 102 is bolted to foldable roof trusses 106.
3) Intersector holes 103 respectively are molded into four-way circular roof intersector 102, four upper corner intersectors 109, and four lower corner intersectors 110.
4) Bolts 104 respectively are inserted through intersector holes 103.
5) Nuts 105 respectively are screwed onto bolts 104.
6) Foldable roof trusses 106 respectively are bolted to four-way circular roof intersector 102 and four upper corner intersectors 109.
7) Foldable side trusses 107 respectively are bolted to four upper corner intersectors 109 and four lower corner intersectors 110.
8) Truss holes 108 respectively are drilled into foldable roof trusses 106 and foldable side trusses 107.
9) Four upper corner intersectors 109 respectively are bolted to foldable roof trusses 106 and foldable side trusses 107, and attached to the top ends of four upper octagonal posts 115.
10) Four lower corner intersectors 110 respectively are bolted to foldable roof trusses 106 and foldable side trusses 107, and slid over four upper octagonal posts 115.
11) Four automatic rounded-head see-saw post locks 111 respectively are hinged to four lower corner intersectors 110.
12) Four see-saw-post-lock springs 112 respectively are attached between four lower corner intersectors 110 and four automatic rounded-head see-saw post locks 111.
13) Four multi-function latch-pulley-handles 113 respectively are riveted to four upper octagonal posts 115.
14) Handle rivets 114 respectively are attached to four multi-function latch-pulley-handles 113 and four upper octagonal posts 115.
15) Four upper octagonal posts 115 respectively are slip over four lower octagonal posts 121.
16) Four multi-function post-centering water-discharging tick-preventing braces 116 respectively are slid on the bottom ends of four upper octagonal posts 115.
17) Tick-preventing downward teeth 117 respectively are molded on the inner surfaces of four multi-function post-centering water-discharging tick-preventing braces 116.
18) Water-discharging recesses 118 respectively are molded on the inner surfaces of four multi-function post-centering water-discharging tick-preventing braces 116.
19) Four V-shaped post-locking springs 119 respectively are springably inserted inside four lower octagonal posts 121.
20) Post-height-adjusting tapered holes 120 respectively are drilled into four upper octagonal posts 115 and four lower octagonal posts 121.
21) Four lower octagonal posts 121 respectively are slid into four upper octagonal posts 115.
22) Four multi-function-latch-pulley-wheel systems 122 respectively have the combined connections of its components.
23) Wheel chassis 123 is welded onto four lower octagonal posts 121.
24) Wheel braces 124 respectively are cast to wheel chassis 123.
25) Wheel-axle holes 125 respectively are drilled into wheel braces 124.
26) Wheel axle 126 is attached to wheel-axle holes 125.
27) Multi-function latch-pulley-wheel 127 is rotatably slid on wheel axle 126.
28) Post ankle 128 is cast to wheel chassis 123.
29) Post foot 129 is cast to post ankle 128.
30) Stake hole 130 is drilled into post foot 129.

Function

Referring to FIG. 14, FIG. 15, FIG. 16A, FIG. 16B, FIG. 16C, FIG. 16D, FIG. 17A, FIG. 17B, FIG. 17C, FIG. 17D, FIG. 18A, FIG. 18B, and FIG. 18C:

1) Foldable-frame tick-preventing-brace multi-function-latch-pulley-handle system 101 is for performing the combined functions of its components.
2) Four-way circular roof intersector 102 is for:
Foldably attaching to foldable roof trusses 106.
3) Intersector holes 103 respectively are for:
Screwing bolts 104 therethrough.
4) Bolts 104 respectively are for:
Attaching four-way circular roof intersector 102, foldable roof trusses 106, foldable side trusses 107, upper corner intersectors 109, and four lower corner intersectors 110 together.
5) Nuts 105 respectively are for:
Securing bolts 104.
6) Foldable roof trusses 106 respectively are for:
Supporting four-way circular roof intersector 102.
7) Foldable side trusses 107 respectively are for:
Supporting foldable roof trusses 106.
8) Truss holes 108 respectively are for:
Screwing bolts 104 therethrough.
9) Four upper corner intersectors 109 respectively are for:
Attaching foldable roof trusses 106 and foldable side trusses 107 to four upper octagonal posts 115.
10) Four lower corner intersectors 110 respectively are for:
Slidably attaching foldable side trusses 107 to four upper octagonal posts 115.
11) Four automatic rounded-head see-saw post locks 111 respectively are for:
Automatically snap-locking into post-height-adjusting tapered holes 120 to secure four lower corner intersectors 110 to four upper octagonal posts 115
to eliminate the need for using a thumb to press down four automatic rounded-head see-saw post locks 111 (see FIG. 6 and FIG. 7).
12) Four see-saw-post-lock springs 112 respectively are for:
Springingly pushing against four automatic rounded-head see-saw post locks 111
(see FIG. 6 and FIG. 7).
13) Four multi-function latch-pulley-handles 113 respectively are for (functioning as a latch, as a pulley, and as a handle, as follows):

a) (Functioning as a latch)
Bundling foldable side trusses 107
to secure the tick-preventing multi-function-latch-pulley-handle multi-function-latch-pulley-wheel popup in a closed position for storage
(see FIG. 10 and FIG. 14);
b) (Functioning as a handle)
Towing the tick-preventing multi-function-latch-pulley-handle multi-function-latch-pulley-wheel popup on multi-function latch-pulley-wheels 127
(see FIG. 15);
c) (Functioning as a handle)
Easily deploying the tick-preventing multi-function-latch-pulley-handle multi-function-latch-pulley-wheel popup
(see FIG. 9); and
d) (Functioning as a pulley)
Working together with multi-function latch-pulley-wheel 127
to reduce forces needed to pull on a cable 131 (which is made of nylon, fabric, metallic, or equivalent material, and has first cable end 132 and second cable end 133) and a carabiner 134 to stretch and secure a popup cover 135 (to cover a popup top, popup side, and/or popup post)
(see FIG. 2A, FIG. 16A, FIG. 16B, FIG. 16C, and FIG. 16D).
For example:
Sewing first cable end 132 to popup cover 135
(see FIG. 2A),
Hooking cable 131 on multi-function latch-pulley-wheel 127
(see FIG. 16A),
Hooking second cable end 133 on carabiner 134
(see FIG. 16B and FIG. 16C),
Pulling on cable 131, and
Hooking carabiner 134 on multi-function latch-pulley-handle 113
(see FIG. 16D).

14) Handle rivets 114 respectively are for:
Attaching four multi-function latch-pulley-handles 113 to four upper octagonal posts 115.

15) Four upper octagonal posts 115 respectively are for:
Slidably sliding over four lower octagonal posts 121
to adjust the height of the tick-preventing multi-function-latch-pulley-handle multi-function-latch-pulley-wheel popup.

16) Four multi-function post-centering water-discharging tick-preventing braces 116 respectively are for:
Automatically Slidably centering four lower octagonal posts 121 inside four upper octagonal posts 115
(see FIG. 13).

17) Tick-preventing downward teeth 117 respectively are for:
Preventing ticks from entering inside four upper octagonal posts 115
to prevent ticks from hiding inside four upper octagonal posts 115
(see FIG. 13).

18) Water-discharging recesses 118 respectively are for:
Allowing rain water to drain away from inside four upper octagonal posts 115
to prevent four upper octagonal posts 115 from rusting
(see FIG. 13).

19) Four V-shaped post-locking springs 119 respectively are for:
Snap-locking through post-height-adjusting tapered holes 120 to secure four upper octagonal posts 115 to four lower octagonal posts 121
to adjust the height of the tick-preventing multi-function-latch-pulley-handle multi-function-latch-pulley-wheel popup.

20) Post-height-adjusting tapered holes 120 respectively are for:
Allowing V-shaped post-locking springs 119 to snap-lock threrethrough
to secure four upper octagonal posts 115 to four lower octagonal posts 121 (when they are retracted for storage), and
to adjust the height of the tick-preventing multi-function-latch-pulley-handle multi-function-latch-pulley-wheel popup (when they are extended for use)
(see FIG. 6 and FIG. 7).

21) Four lower octagonal posts 121 respectively are for:
Slidably sliding into four upper octagonal posts 115
to adjust the height of the tick-preventing multi-function-latch-pulley-handle multi-function-latch-pulley-wheel popup.

22) Four multi-function-latch-pulley-wheel systems 122 respectively are for performing the combined functions of its components.

23) Wheel chassis 123 is for:
Connecting four lower octagonal posts 121 to wheel braces 124.

24) Wheel braces 124 respectively are for:
a) Connecting wheel axle 126 to wheel braces 124
b) Hooking second cable end 133 thereon
to secure popup cover 135 (to cover a popup top, popup side, and/or popup post)
(see FIG. 17A, FIG. 17B, FIG. 17C, and FIG. 17D).

25) Wheel-axle holes 125 respectively are for:
Attaching wheel axle 126 to wheel braces 124.

26) Wheel axle 126 is for:
Rotatably attaching multi-function latch-pulley-wheel 127 to wheel braces 124.

Figure 18A:
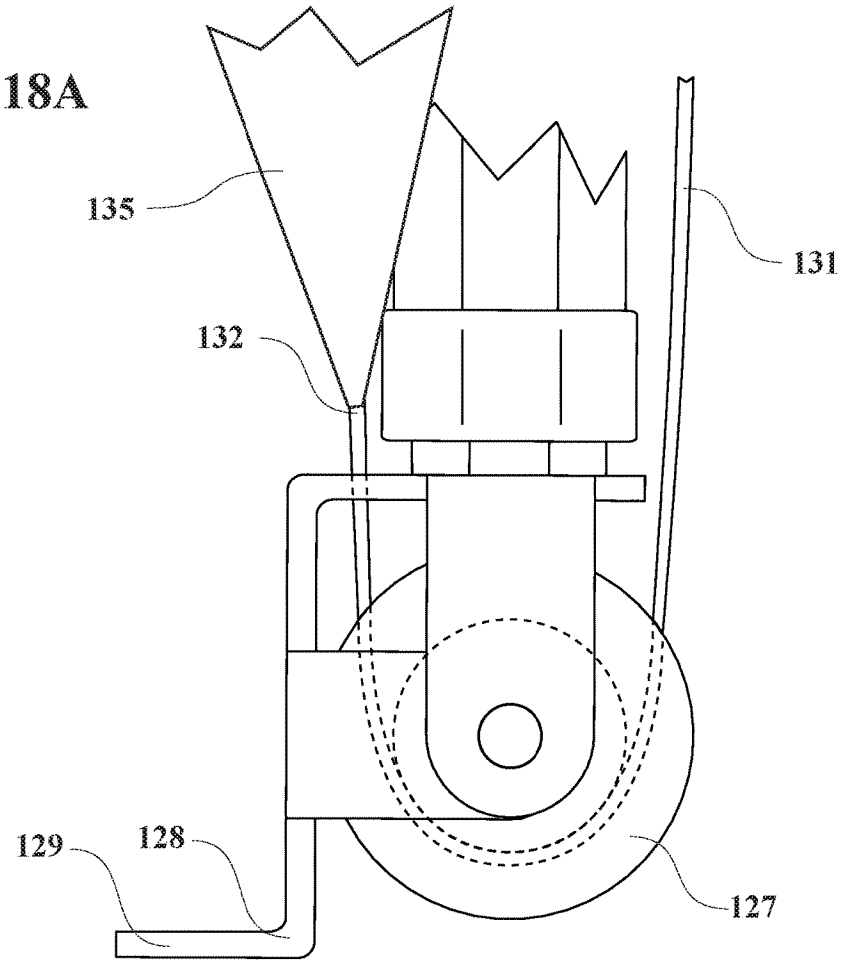
FIG. 18A to FIG. 18C illustrate perspective and side views of how four multi-function latch-pulley-wheels function as pulleys.
Figure 18C:
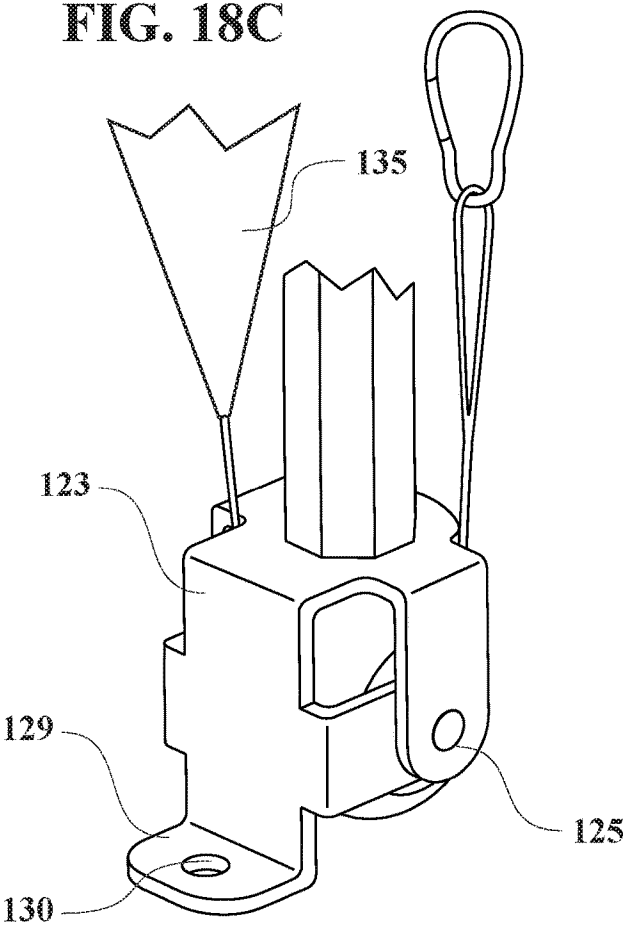
Figure 18B:
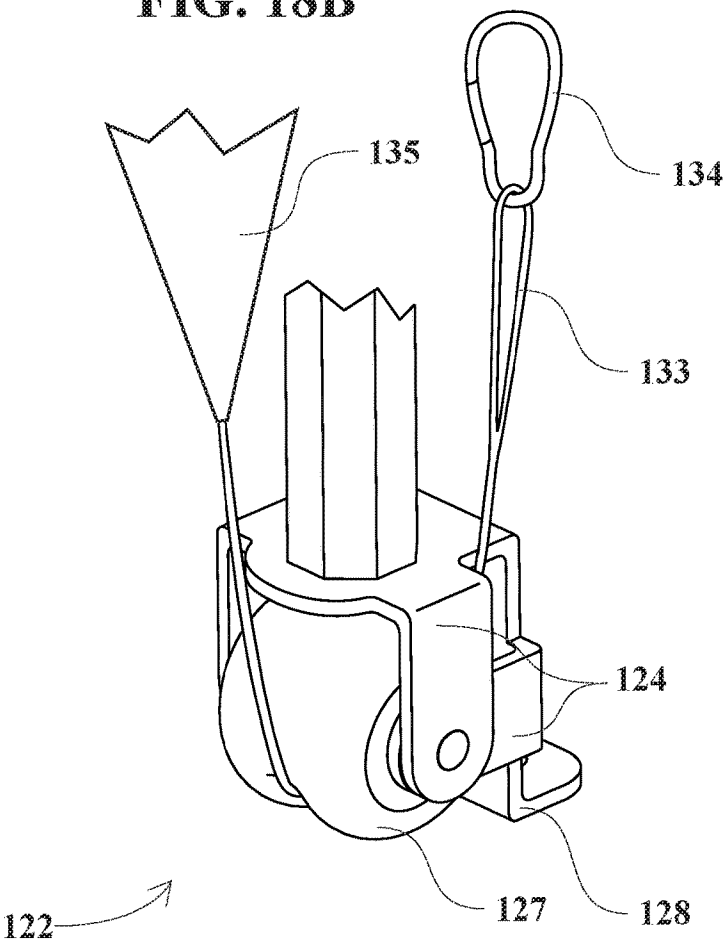
Figure 19A:
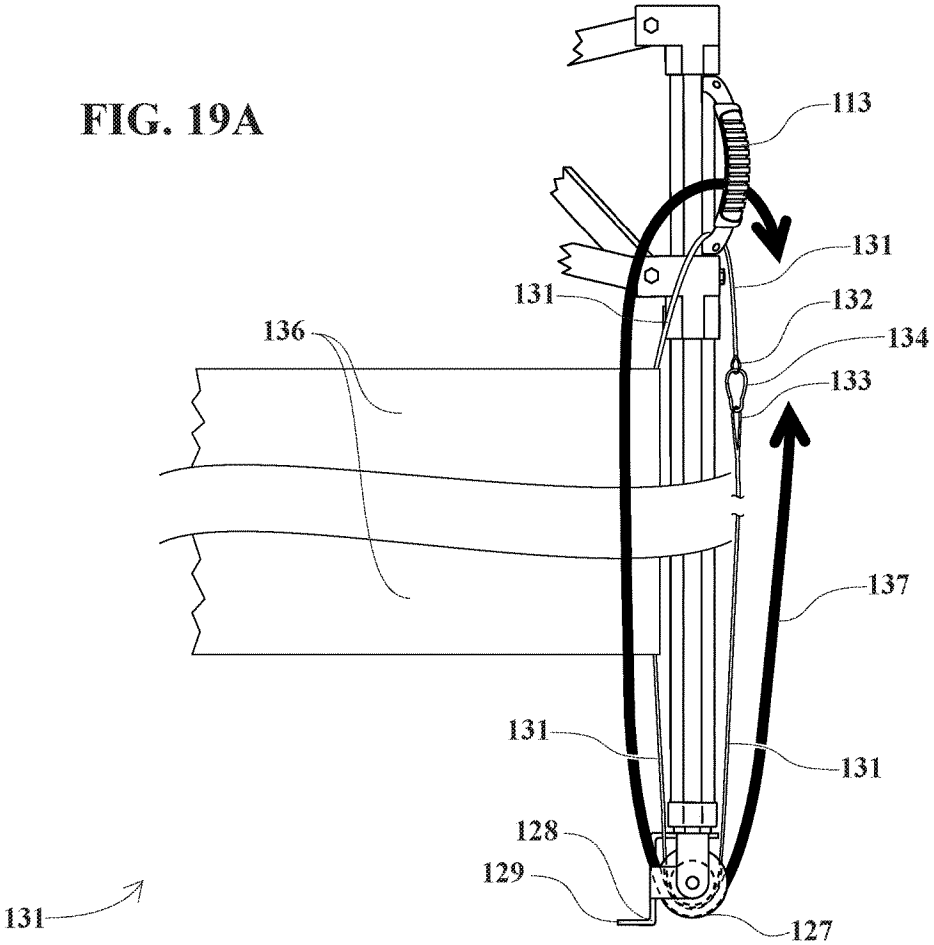
FIG. 19A to FIG. 19F illustrate perspective views of how a cable, a carabiner, a multi-function latch-pulley-wheel, and a multi-function latch-pulley-handle work together to adjustably attach a sunshade to the foldable frame.
Figure 19B:
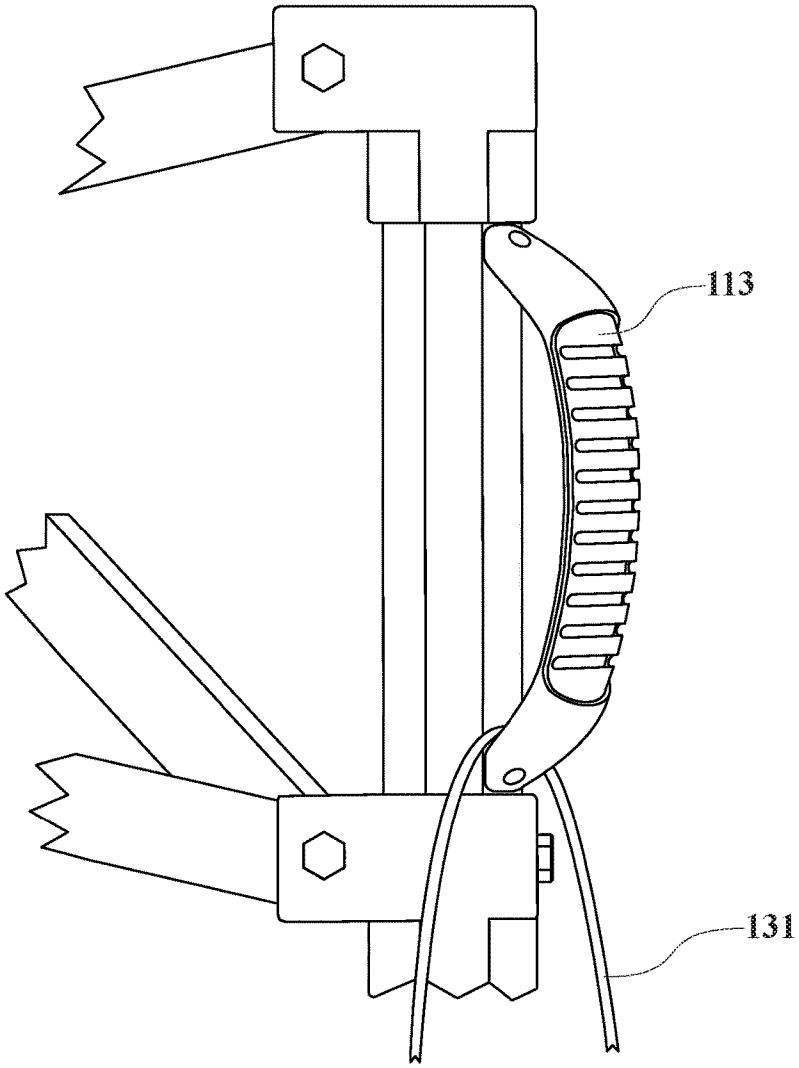
Figure 19C:
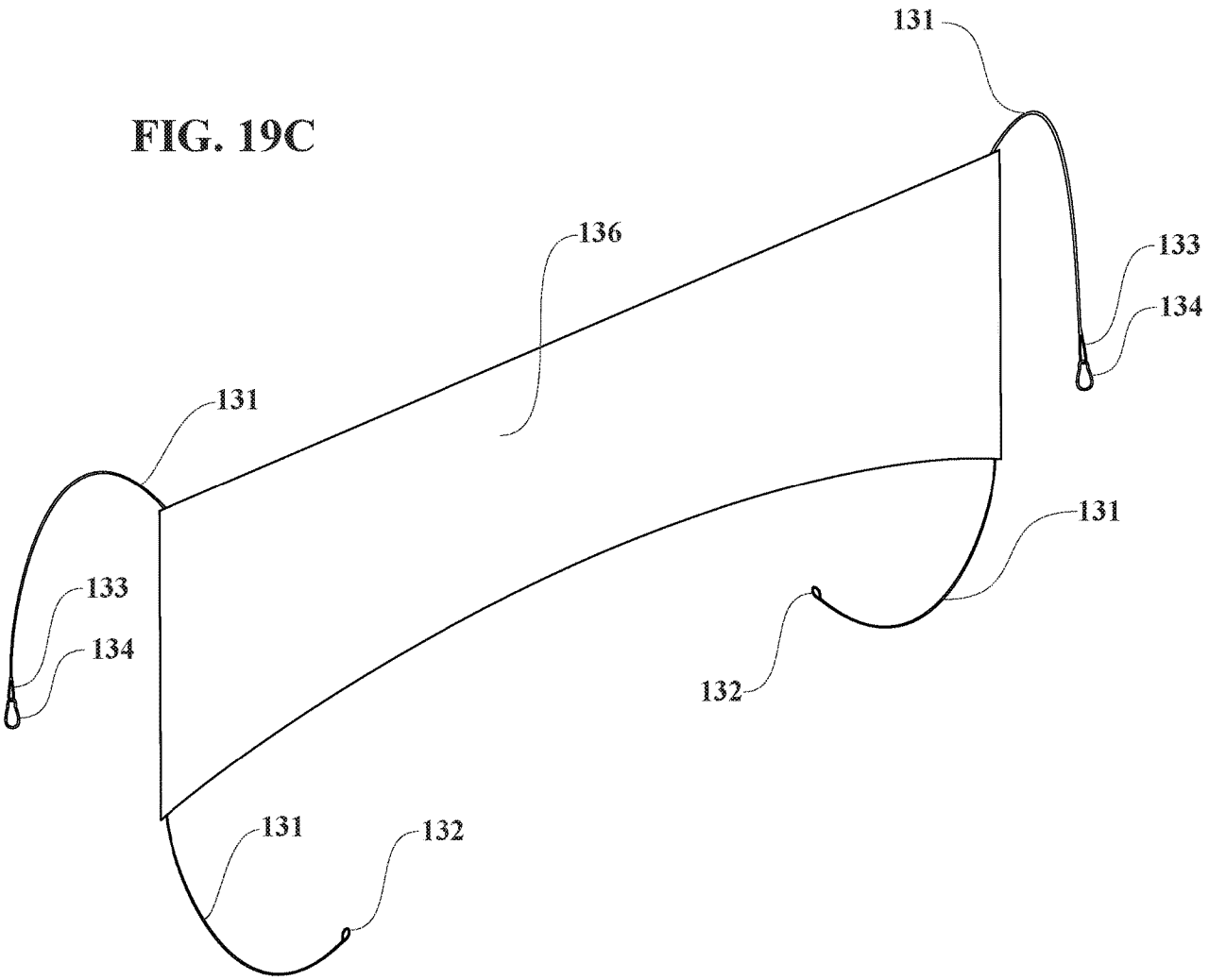
Figure 19E:
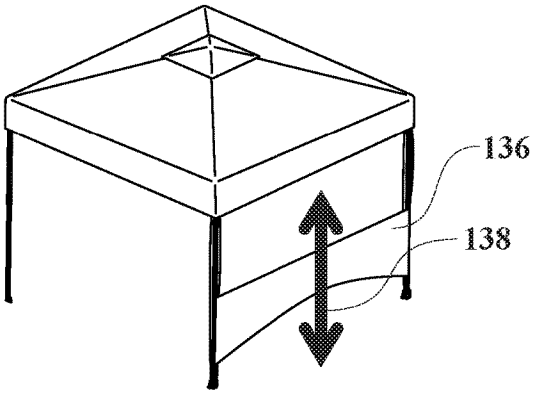
Figure 19D:
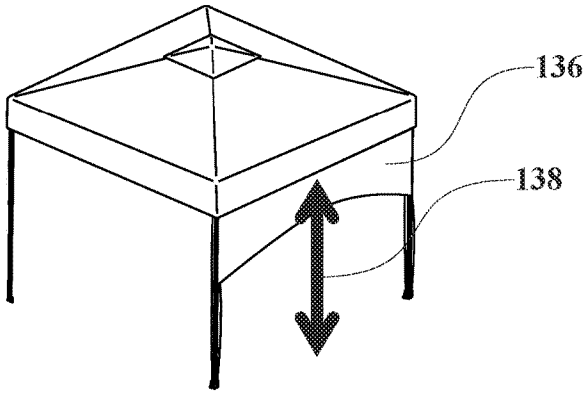
Figure 19F:
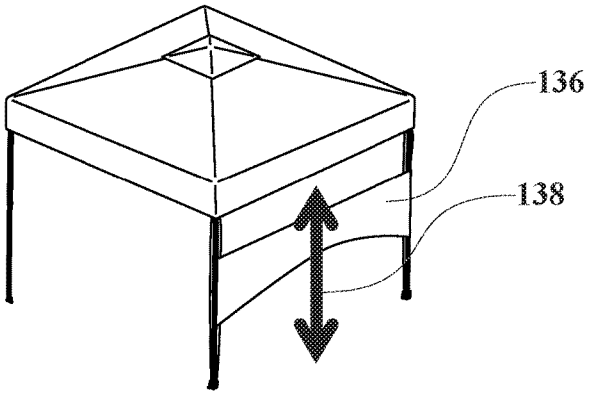
Figure 20A:
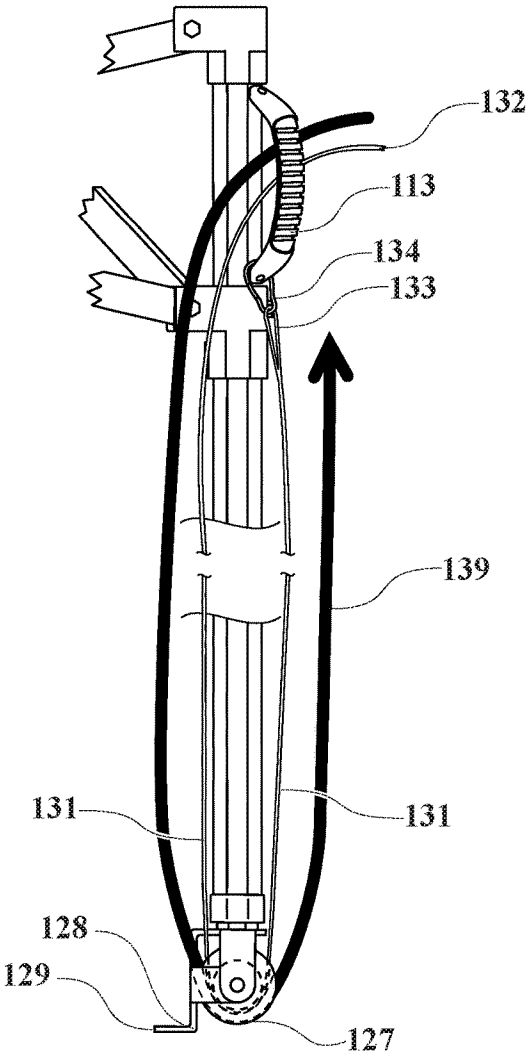
FIG. 20A to 20B illustrate perspective views of a different method to use a cable, a carabiner, a multi-function latch-pulley-wheel, and a multi-function latch-pulley-handle to attach another popup cover to the foldable frame.
Figure 20B:
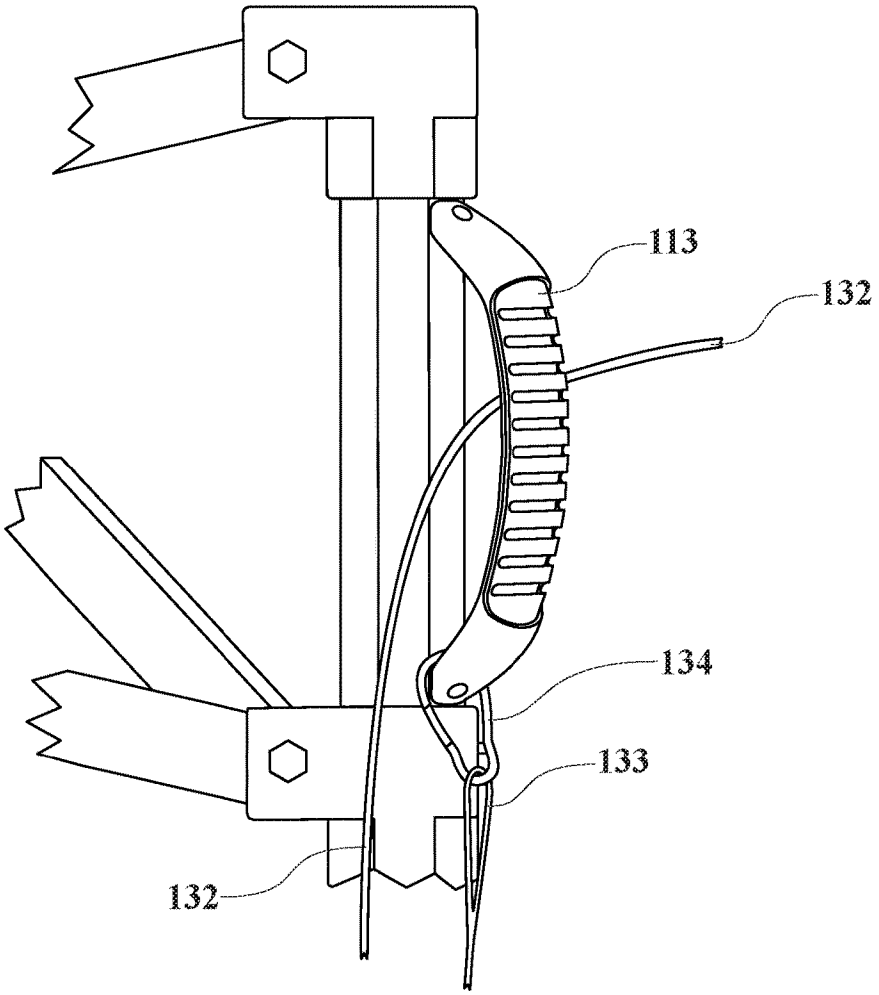
Figure 21:
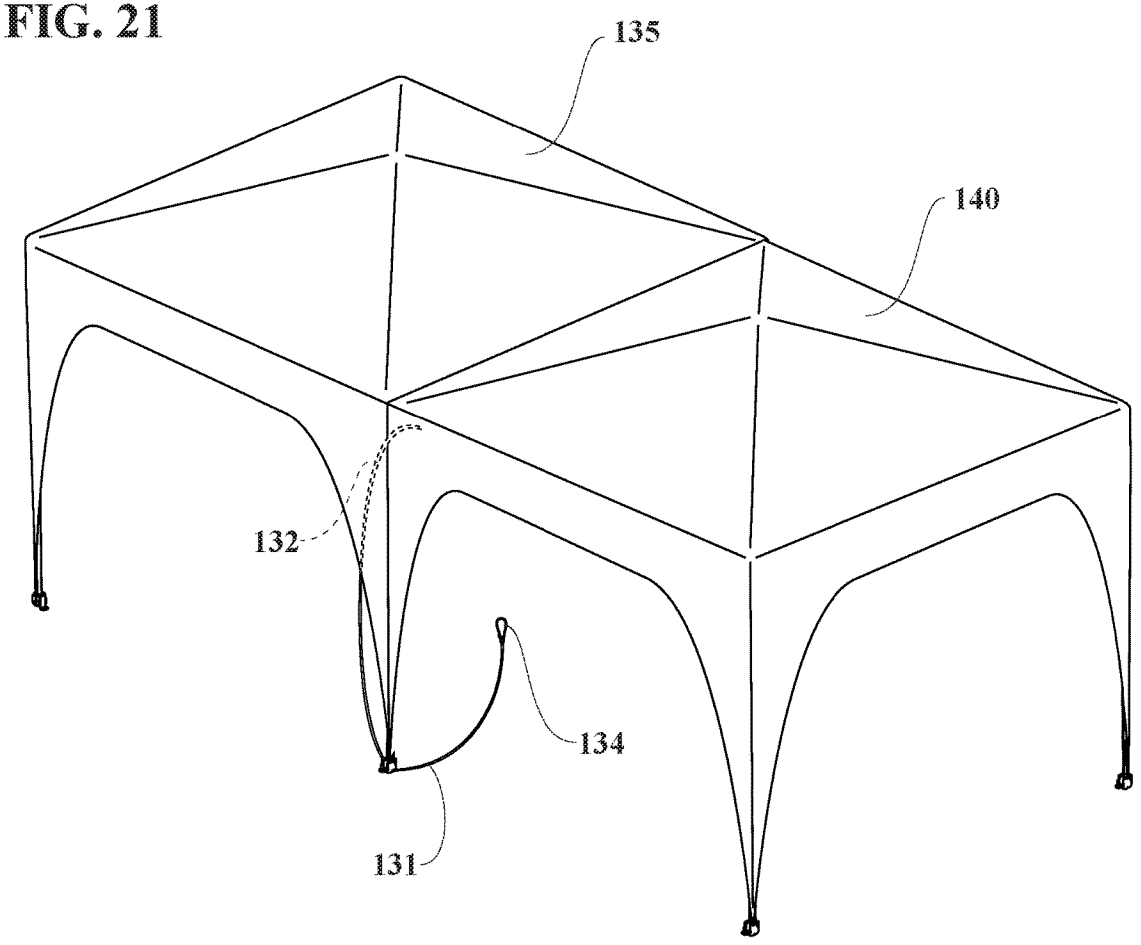
FIG. 21 illustrates a perspective view of how cables, carabiners, multi-function latch-pulley-wheels, and multi-function latch-pulley-handles attach a popup to the tick-preventing multi-function-latch-pulley-handle multi-function-latch-pulley-wheel popup.

27) Multi-function latch-pulley-wheel 127 is for
(functioning as a latch, as a pulley, and as a wheel, as follows):
a) (Functioning as a latch)
Hooking second cable end 133 thereon
to secure popup cover 135 (to cover a popup top, popup side, and/or popup post)
(see FIG. 17A, FIG. 17B, FIG. 17C, and FIG. 17D);
b) (Functioning as a wheel)
Allowing quick and easy transportation of the tick-preventing multi-function-latch-pulley-handle multi-function-latch-pulley-wheel popup
(see FIG. 15); and
c) (Functioning as a pulley)
Working together with multi-function latch-pulley-handle 113
to reduce forces needed to pull on a cable 131 and carabiner 134 to stretch and secure popup cover 135 (to cover a popup top, popup side, and/or popup post)
(see FIG. 18A, FIG. 18B, and FIG. 18C).
For example:
Hooking cable 131 on multi-function latch-pulley-wheel 127
(see FIG. 18A)
Hooking second cable end 133 on carabiner 134
(see FIG. 18B and FIG. 18C), Pulling on cable 131, and Hooking carabiner 134 on multi-function latch-pulley-handle 113.

Figure 16A:
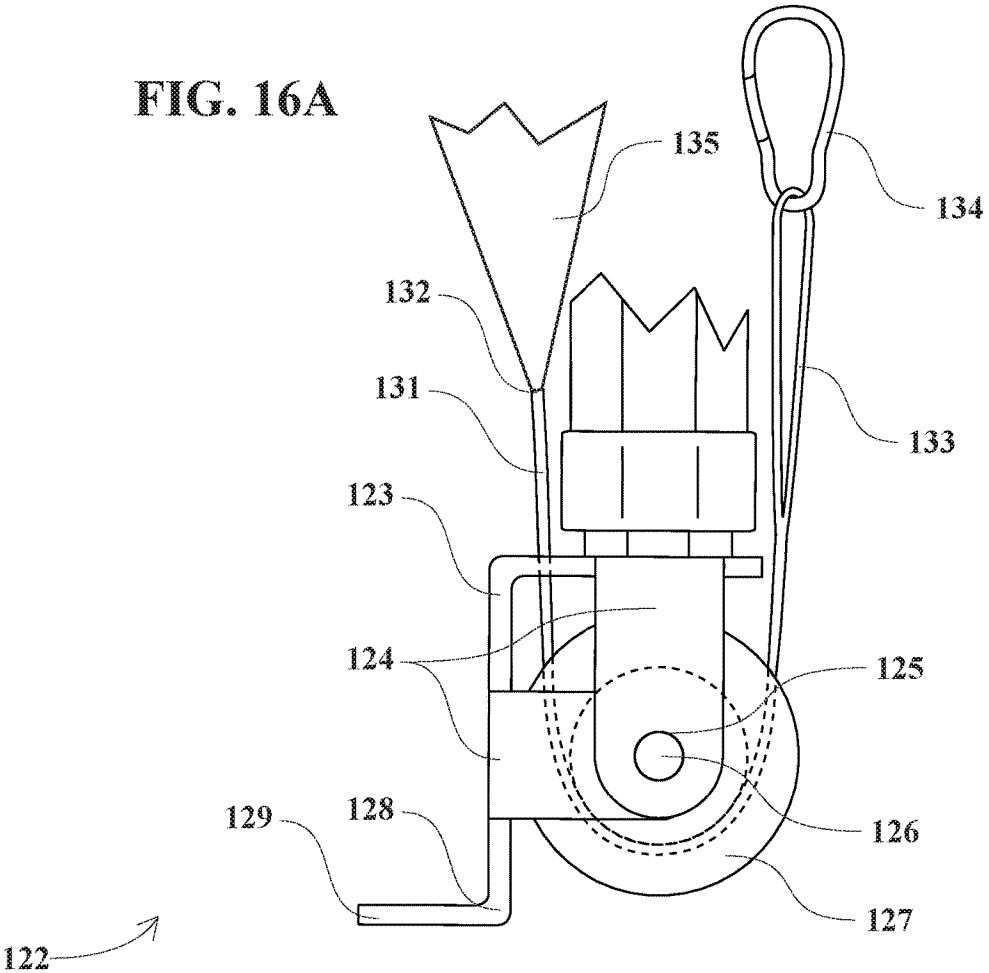
FIG. 16A to FIG. 16D illustrate perspective and side views of how four cables, four carabiners, four multi-function latch-pulley-wheels, and four multi-function latch-pulley-handles work together to attach a popup cover to the foldable frame.
Figure 16C:
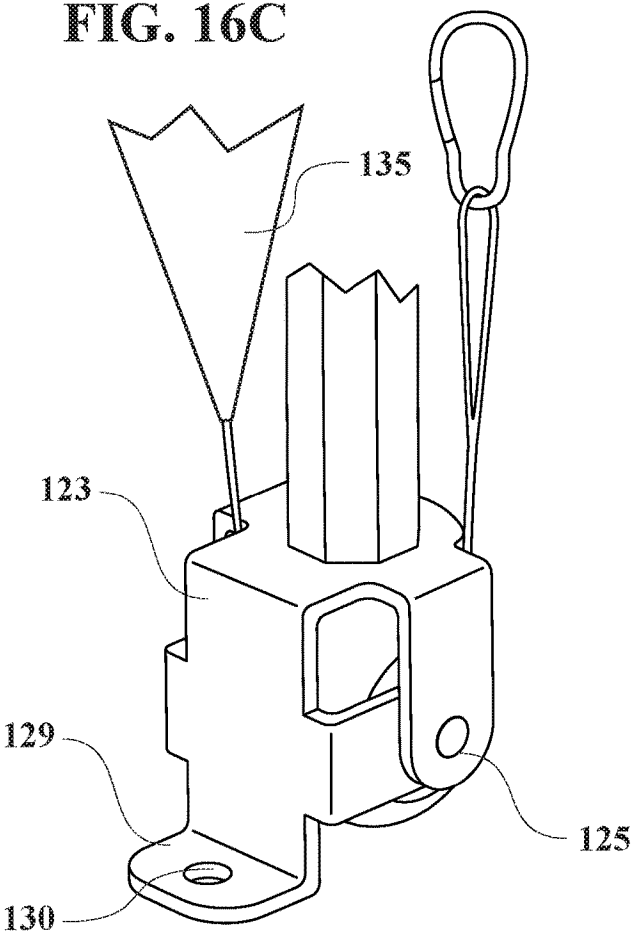
Figure 16B:
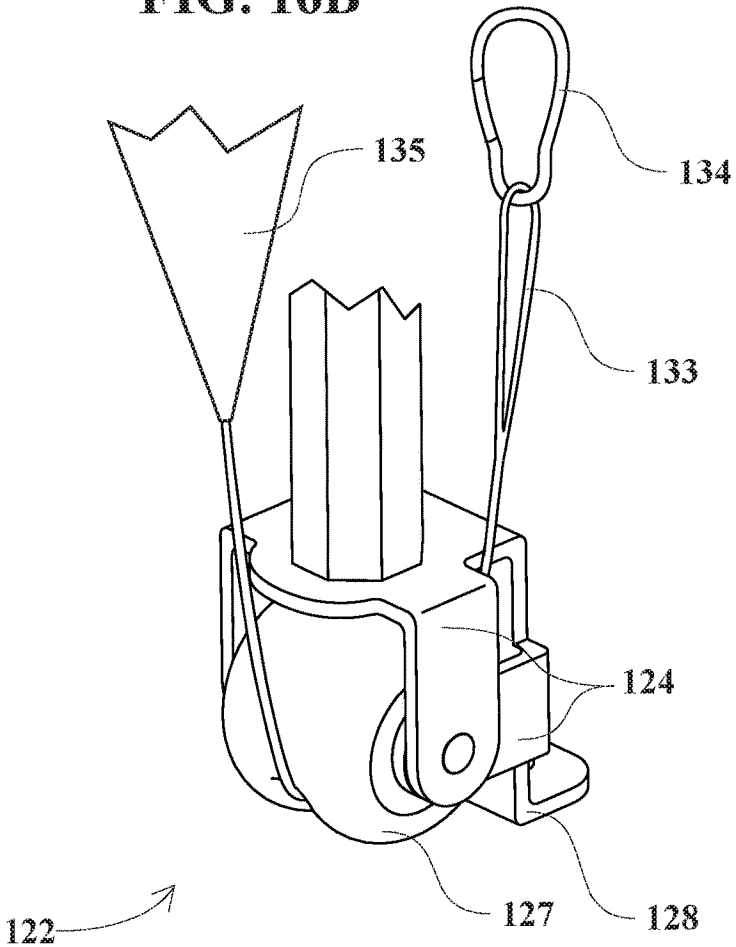
Figure 16D:
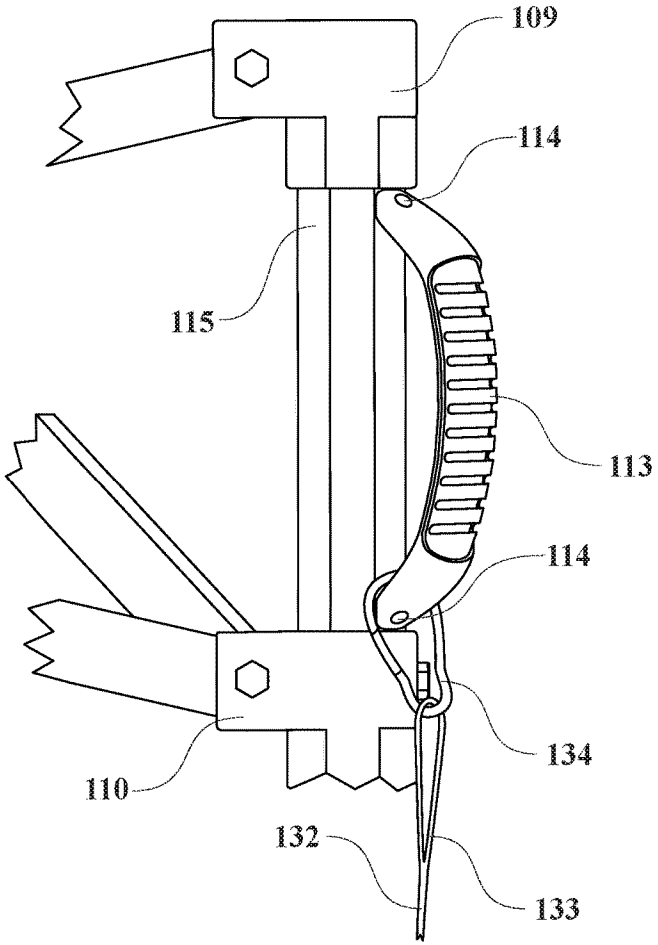
Figure 17B:
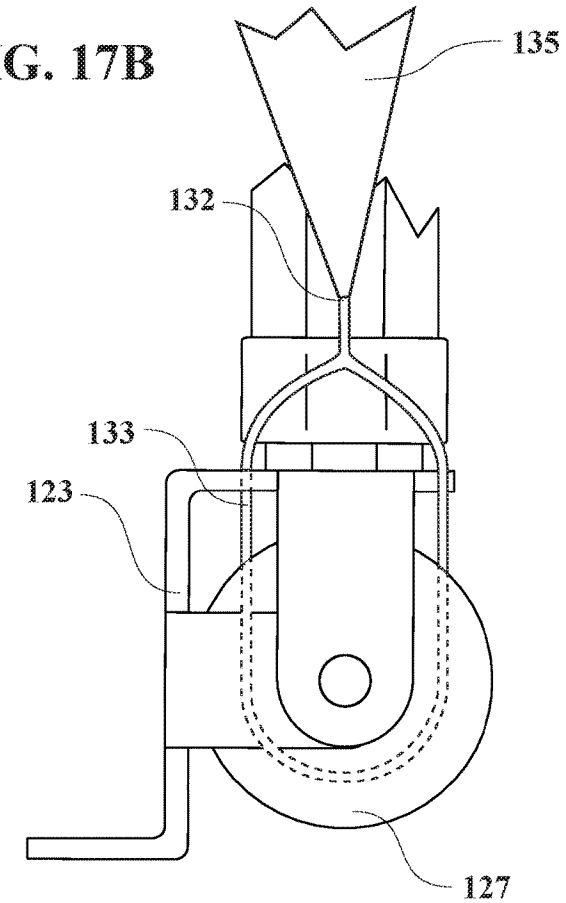
FIG. 17A to FIG. 17D illustrate perspective and side views of how four multi-function latch-pulley-wheels function as latches.
Figure 17A:
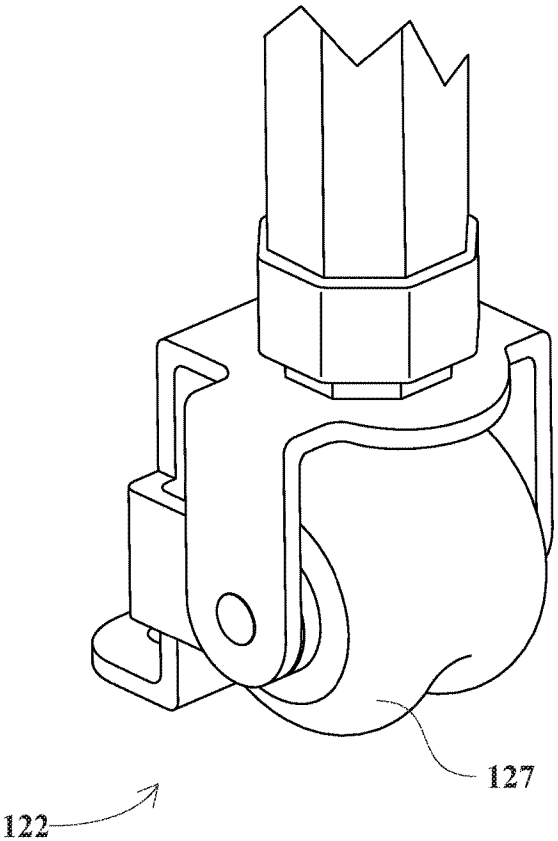
Figure 17D:
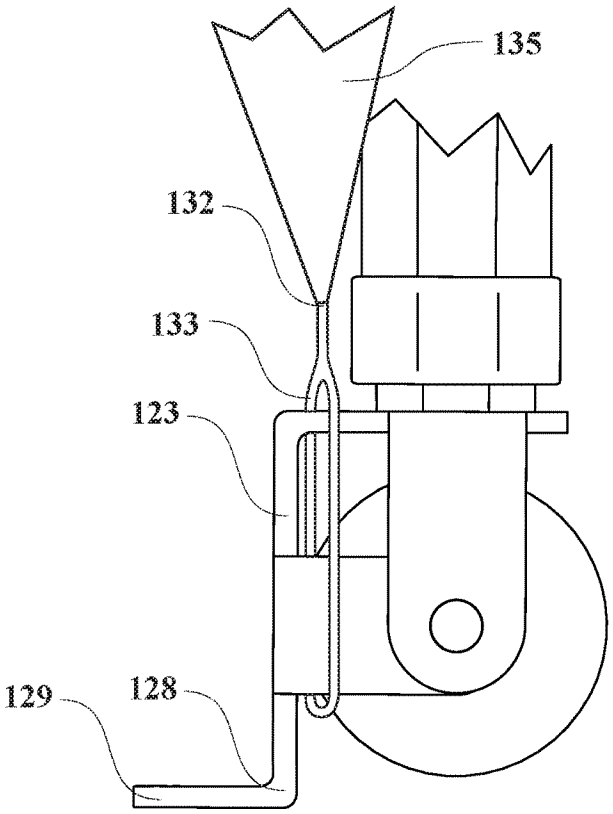
Figure 17C:
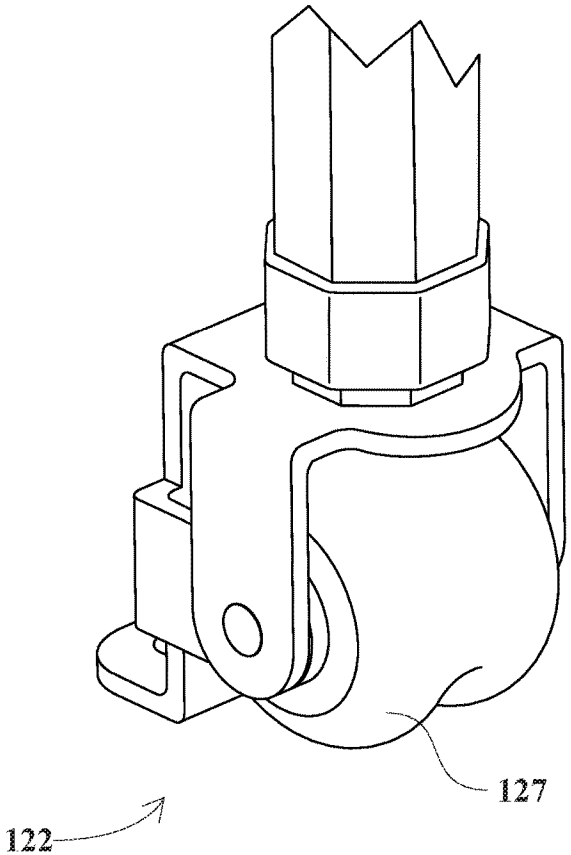

(see FIG. 16D).

28) Post ankle 128 is for:

Connecting wheel chassis 123 to post foot 129.

29) Post foot 129 is for:

Raising multi-function latch-pulley-wheel 127 above the ground, and stabilizing the tick-preventing multi-function-latch-pulley-handle multi-function-latch-pulley-wheel popup on the ground.

30) Stake hole 130 is for:

Angledly guiding a spike into the ground to secure and stabilize the tick-preventing multi-function-latch-pulley-handle multi-function-latch-pulley-wheel popup to the ground.

Variation

Figure 29B:
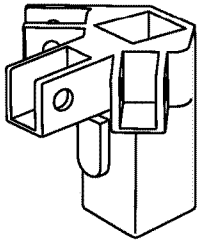
FIG. 29B illustrates a perspective view of an equivalent variation of the lower corner intersectors.
Figure 31:
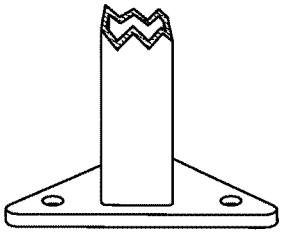
FIG. 31 illustrates a perspective view of an equivalent variation of the lower octagonal post, which has a square cross-section.
Figure 29A:
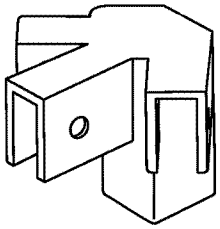
FIG. 29A illustrates a perspective view of an equivalent variation of the upper corner intersector.
Figure 30:
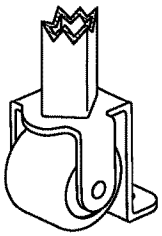
FIG. 30 illustrates a perspective view of an equivalent variation of the multi-function-latch-pulley-wheel system.
Figure 32B:
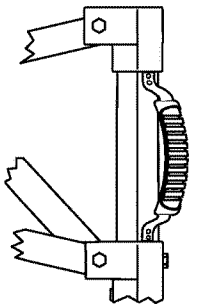
FIGS. 32A to 32B illustrate perspective views of equivalent variations of the multi-function latch-pulley-handles.
Figure 35:
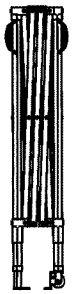
FIG. 35 illustrates a front view of an equivalent variation of the tick-preventing multi-function-latch-pulley-handle multi-function-latch-pulley-wheel popup, which has at least one multi-function-latch-pulley-wheel system.
Figure 34:
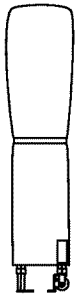
FIG. 34 illustrates a front view of a bag and Velcros for covering the tick-preventing multi-function-latch-pulley-handle multi-function-latch-pulley-wheel popup.
Figure 32A:
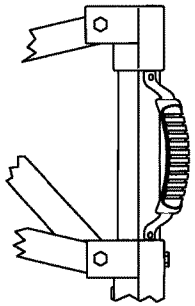
Figure 33:
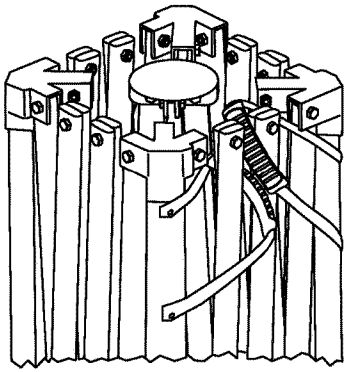
FIG. 33 illustrates a perspective view of equivalent variations of the foldable roof trusses and the foldable side trusses, each of which have an oval cross-section.

Any component of the tick-preventing multi-function-latch-pulley-handle multi-function-latch-pulley-wheel popup can have any shape and size. For example, FIG. 29A illustrates a perspective view of an equivalent variation of upper corner intersector 109, which has a square-tube shape. For example, FIG. 29B illustrates a perspective view of an equivalent variation of lower corner intersectors 110, which has a square-tube shape. For example, FIG. 30 illustrates a perspective view of an equivalent variation of multi-function-latch-pulley-wheel system 122. For example, FIG. 31 illustrates a perspective view of an equivalent variation of lower octagonal post 121, which has a square-tube cross-section. For example, an equivalent variation of upper octagonal posts 115 can have a square-tube cross-section, and an equivalent variation of multi-function post-centering water-discharging tick-preventing brace 116 can have a ring shape with a square cross-section with or without teeth 117 and recesses 118. For example, FIG. 32A and FIG. 32B each illustrate a perspective view of an equivalent variation of multi-function latch-pulley-handle 113. The equivalent handle is made of rubber and/or nylon material(s). For example, FIG. 33 illustrates a perspective view of equivalent variations of foldable roof trusses 106 and foldable side trusses 107. The equivalent trusses can have oval cross-sections. For example, FIG. 34 illustrates a front view of a bag and Velcros for covering the tick-preventing multi-function-latch-pulley-handle multi-function-latch-pulley-wheel popup. For example, FIG. 35 illustrates a front view of an equivalent variation of the tick-preventing multi-function-latch-pulley-handle multi-function-latch-pulley-wheel popup, which has at least one multi-function-latch-pulley-wheel system 122. Any component of the tick-preventing multi-function-latch-pulley-handle multi-function-latch-pulley-wheel popup can be made of any material(s) or any combination of any materials. Any component-attaching method of the tick-preventing multi-function-latch-pulley-handle multi-function-latch-pulley-wheel popup can be replaced with an equivalent method. Any component of the tick-preventing multi-function-latch-pulley-handle multi-function-latch-pulley-wheel popup can be replaced with an equivalent. Any component of the tick-preventing multi-function-latch-pulley-handle multi-function-latch-pulley-wheel popup can be made of any flexible, semi-flexible, bendable, semi bendable, rigid, or semi-rigid material(s).

MAJOR ADVANTAGES OF THE INVENTION

The present invention substantially departs from the conventional concepts and designs of the prior art. In doing so, the present invention provides a tick-preventing multi-function-latch-pulley-handle and multi-function-latch-pulley-wheel popup (having: 1) Post-centering braces, 2) Water-discharging recesses, 3) Tick-preventing teeth, 4) Multi-function latch-pulley-handles, and 5) Multi-function latch-pulley-wheels) having many unique and significant features, functions, and advantages, which overcome all the disadvantages of the prior art, as follows:

1) It is an object of the new invention to provide a tick-preventing multi-function-latch-pulley-handle and multi-function-latch-pulley-wheel popup, having four multi-function latch-pulley-handles 113.

Figure 10:
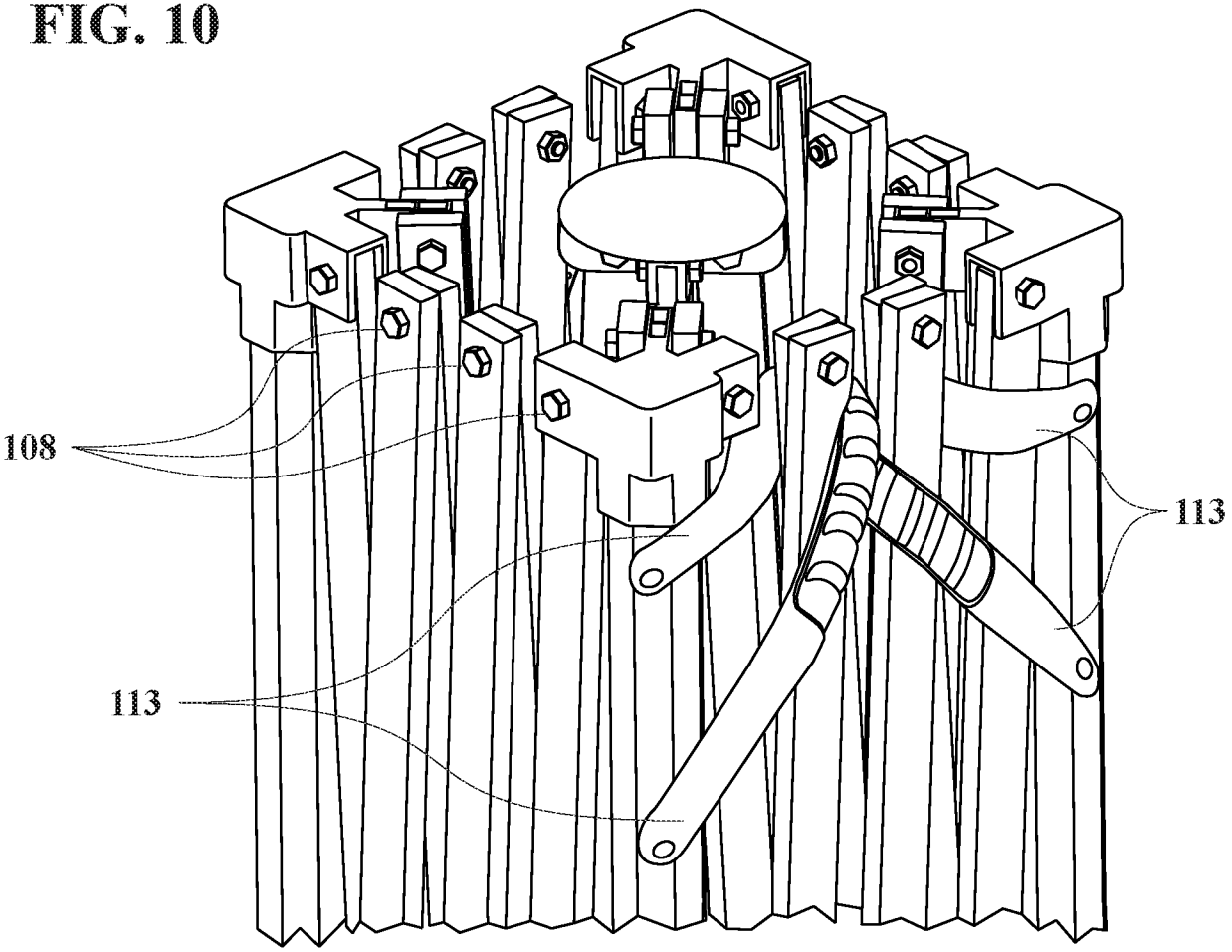
Figure 12:
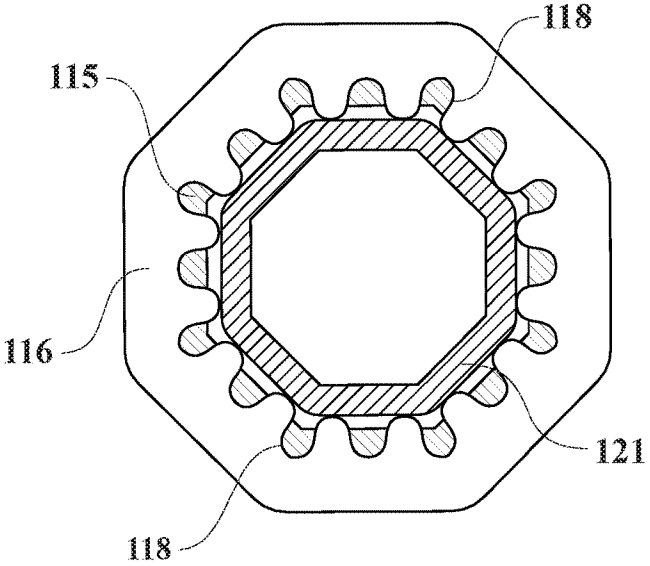
FIG. 11 to FIG. 13 illustrate perspective and cross-sectional views of how multi-function post-centering water-discharging tick-preventing braces discharge water and prevent ticks from entering upper octagonal posts.
Figure 11:
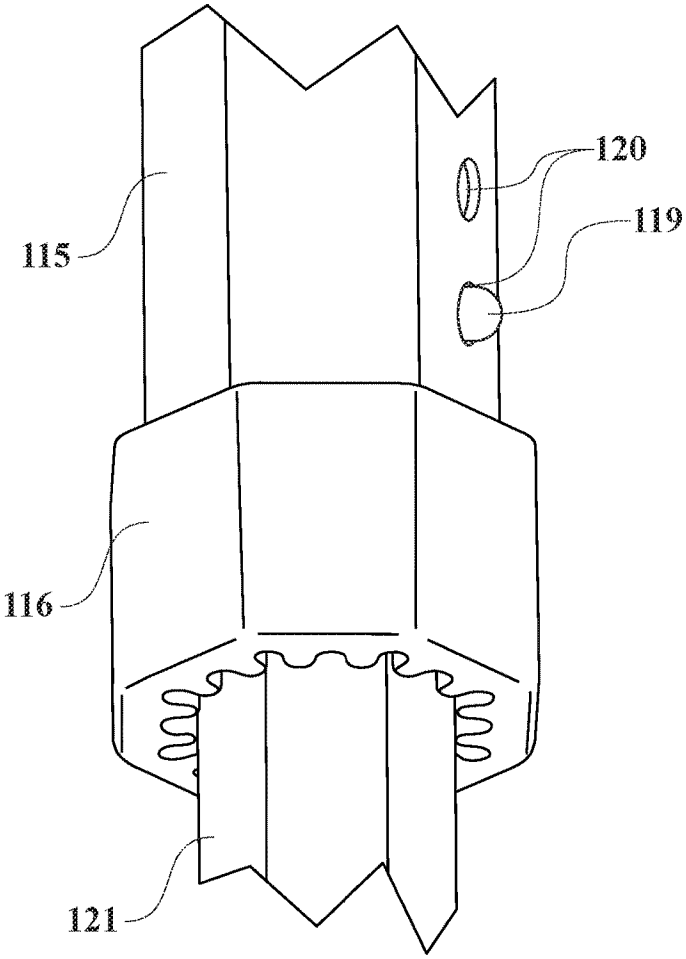
Figure 14:
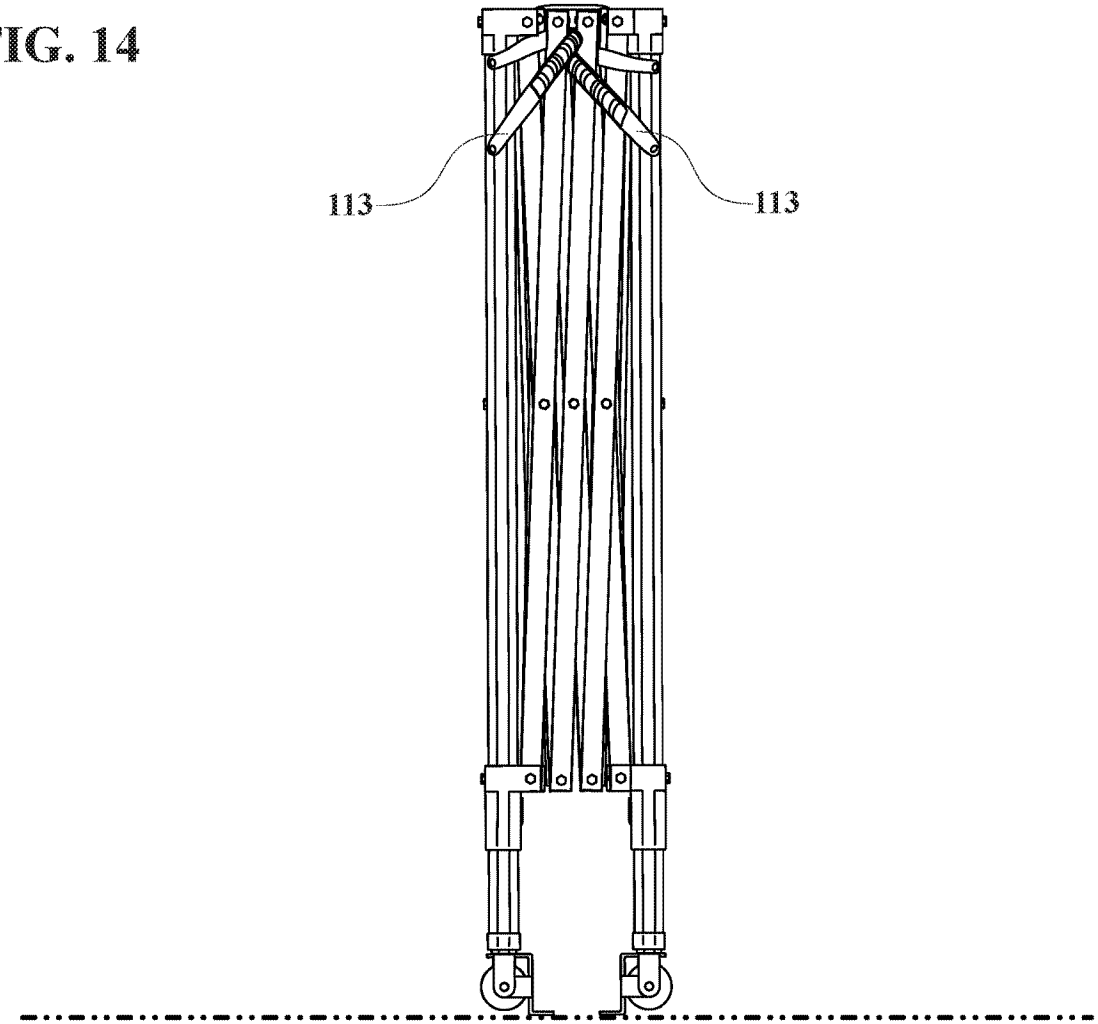
FIG. 14 illustrates a front view of how four multi-function latch-pulley-handles bundle the tick-preventing multi-function-latch-pulley-handle multi-function-latch-pulley-wheel popup.
Figure 15:
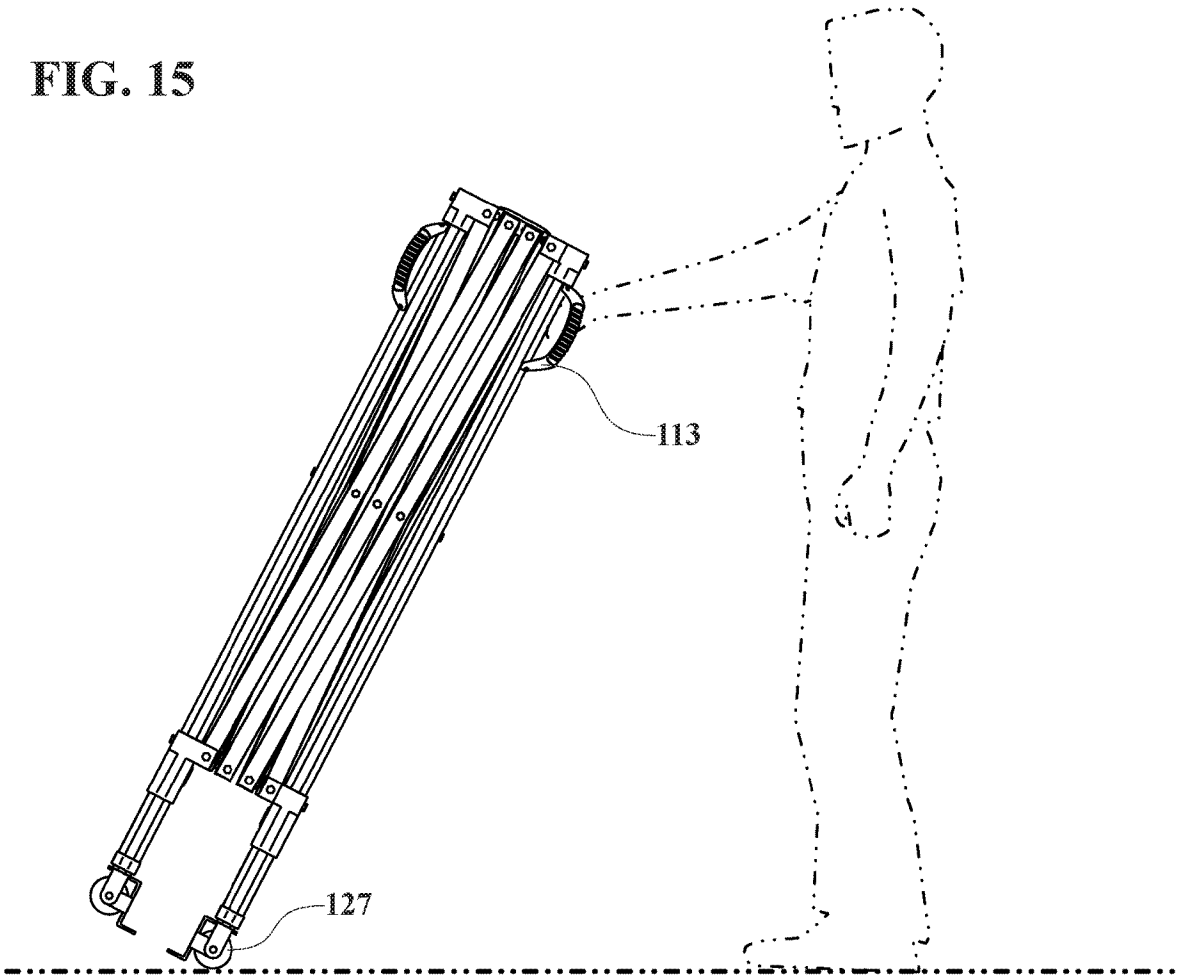
FIG. 15 illustrates a side view of how to tow the tick-preventing multi-function-latch-pulley-handle multi-function-latch-pulley-wheel popup, using four multi-function latch-pulley-handles.

Therefore, the tick-preventing multi-function-latch-pulley-handle and multi-function-latch-pulley-wheel popup:

a) Can be used as a latch, to bundle the tick-preventing multi-function-latch-pulley-handle and multi-function-latch-pulley-wheel popup when collapsed for easy storage (see FIG. 10 and FIG. 14);

b) Can be used as a handle, to tow and lift the tick-preventing multi-function-latch-pulley-handle and multi-function-latch-pulley-wheel popup (see FIG. 15);

c) Can be used as a handle, to easily deploy the tick-preventing multi-function-latch-pulley-handle and multi-function-latch-pulley-wheel popup (see FIG. 9); and d) Can be used as a pulley, to be used with a cable 131 to secure popup cover 135 to the tick-preventing multi-function-latch-pulley-handle and multi-function-latch-pulley-wheel popup (see FIG. 2A, FIG. 16A, FIG. 16B, FIG. 16C, and FIG. 16D).

For example:

One can not sew first cable end 132 to popup cover 135

(FIG. 2A),

One can not hook cable 131 on multi-function latch-pulley-wheel 127

(FIG. 16A),

One can not hook second cable end 133 on carabiner 134

(FIGS. 16B and 16C),

One can not pull on cable 131, and

One can not hook carabiner 134 on multi-function latch-pulley-handle 113

(FIG. 16D).

2) It is another object of the new invention to provide a tick-preventing multi-function-latch-pulley-handle and multi-function-latch-pulley-wheel popup, having four multi-function post-centering water-discharging tick-preventing braces 116.

Figure 13:
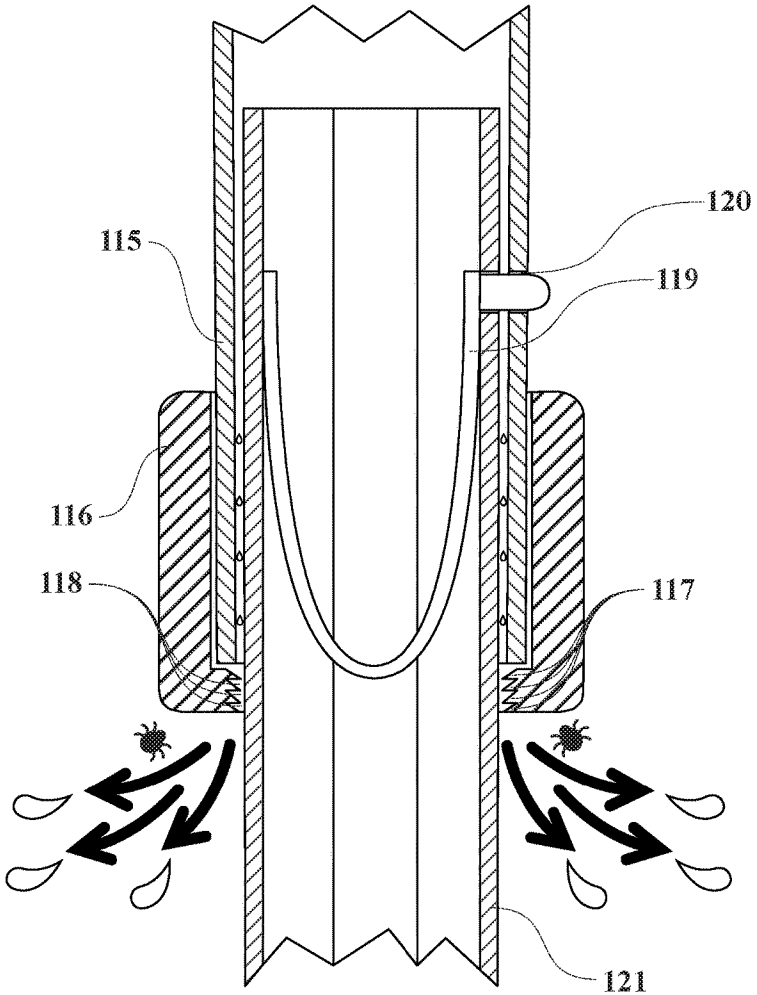

Therefore, the tick-preventing multi-function-latch-pulley-handle and multi-function-latch-pulley-wheel popup:

a) Can center four lower octagonal posts 121 within four upper octagonal posts 115, to make assembly of the tick-preventing multi-function-latch-pulley-handle and multi-function-latch-pulley-wheel popup easier (see FIG. 13);

b) Can center four lower octagonal posts 121 within four upper octagonal posts 115, to cause less friction when adjusting height of the tick-preventing multi-function-latch-pulley-handle and multi-function-latch-pulley-wheel popup (see FIG. 13);

c) Can help prevent ticks and other bugs from entering four upper octagonal posts 115,
to keep pets and occupants safe
(see FIG. 13); and d) Can help with water drainage,
to prevent rusting
(see FIG. 13).

3) It is still another object of the new invention to provide a tick-preventing multi-function-latch-pulley-handle and multi-function-latch-pulley-wheel popup, having tick-preventing downward teeth 117.

Therefore, the tick-preventing multi-function-latch-pulley-handle and multi-function-latch-pulley-wheel popup:

a) Can prevent ticks and other pests from entering four upper octagonal posts 115,
to keep pets and other occupants safe
(see FIG. 13);

b) Can help with water drainage,
to prevent rusting
(see FIG. 13);

c) Can help to center four lower octagonal posts 121 inside four upper octagonal posts 115,
to help keep the lower post from scratching the upper posts
(see FIG. 13); and d) Can be used to buffer four lower octagonal posts 121 within four upper octagonal posts 115,
to help making adjusting height of easier
(see FIG. 13).

4) It is a further object of the new invention to provide a tick-preventing multi-function-latch-pulley-handle and multi-function-latch-pulley-wheel popup, having water-discharging recesses 118.

Therefore, the tick-preventing multi-function-latch-pulley-handle and multi-function-latch-pulley-wheel popup:

a) Can help with water drainage,
to prevent rusting
(see FIG. 13);

b) Can provide buffer between four lower octagonal posts 121 and four upper octagonal posts 115,
to make adjusting the tick-preventing multi-function-latch-pulley-handle and multi-function-latch-pulley-wheel popup easier
(see FIG. 13);

c) Can help prevent ticks and other pests from getting into four lower octagonal posts 121 and four upper octagonal posts 115,
to keep pets and other occupants safe
(see FIG. 13); and d) Can help center four lower octagonal posts 121 inside four upper octagonal posts 115,
to keep four lower octagonal posts 121 from scratching four upper octagonal posts 115
(see FIG. 13).

5) It is an even further object of the new invention to provide a tick-preventing multi-function-latch-pulley-handle and multi-function-latch-pulley-wheel popup, having a multi-function latch-pulley-wheel 127.

Figure 22:
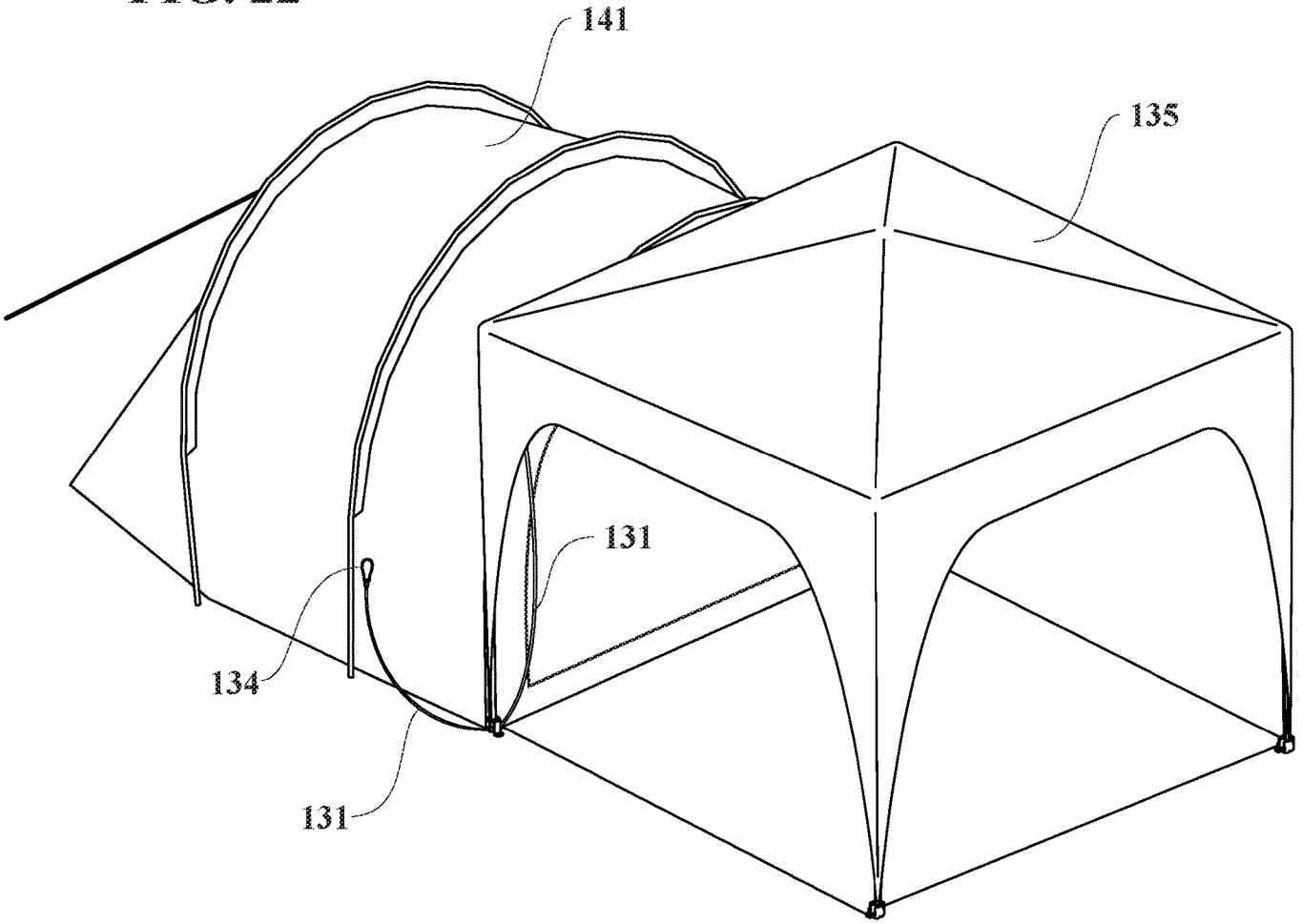
FIG. 22 to FIG. 23 illustrate perspective views of how cables, carabiners, multi-function latch-pulley-wheels, and multi-function latch-pulley-handles attach one or more tents to the tick-preventing multi-function-latch-pulley-handle multi-function-latch-pulley-wheel popup.
Figure 23:
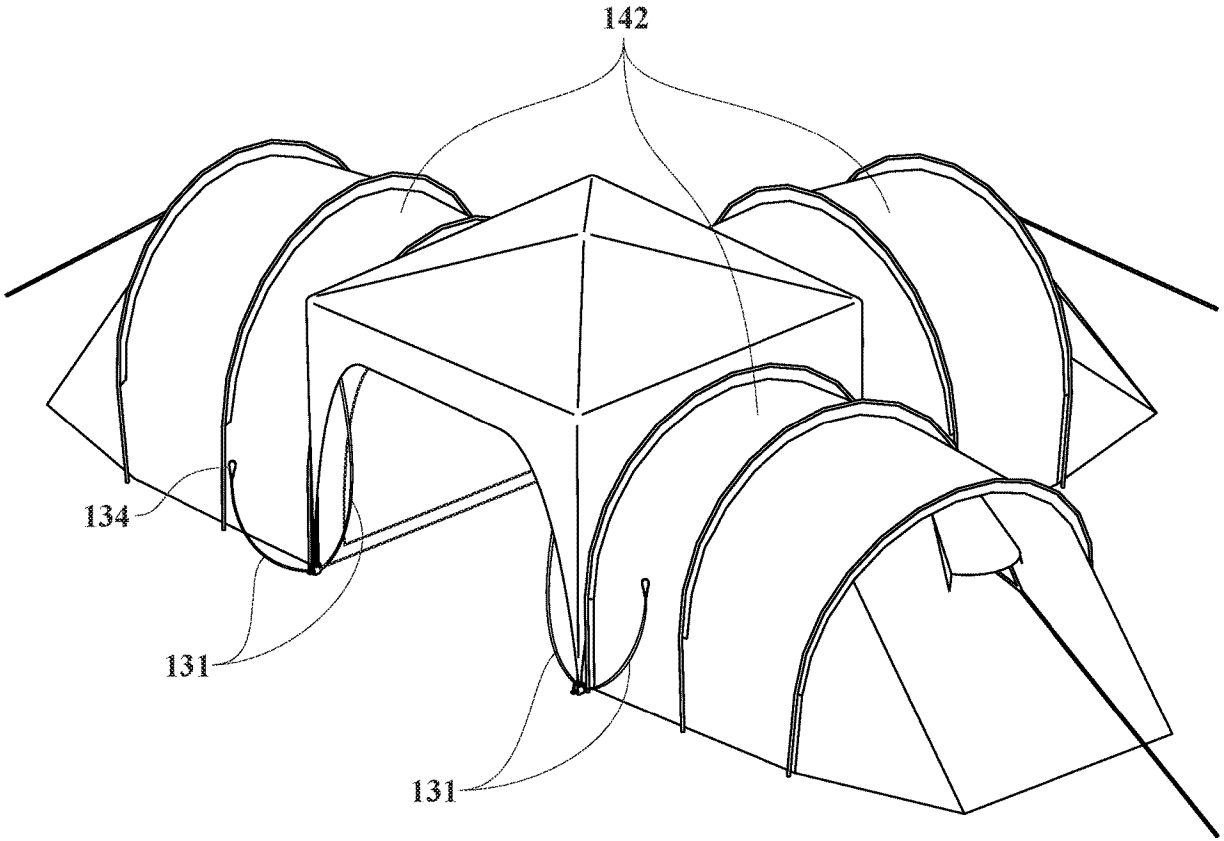
Figure 24:
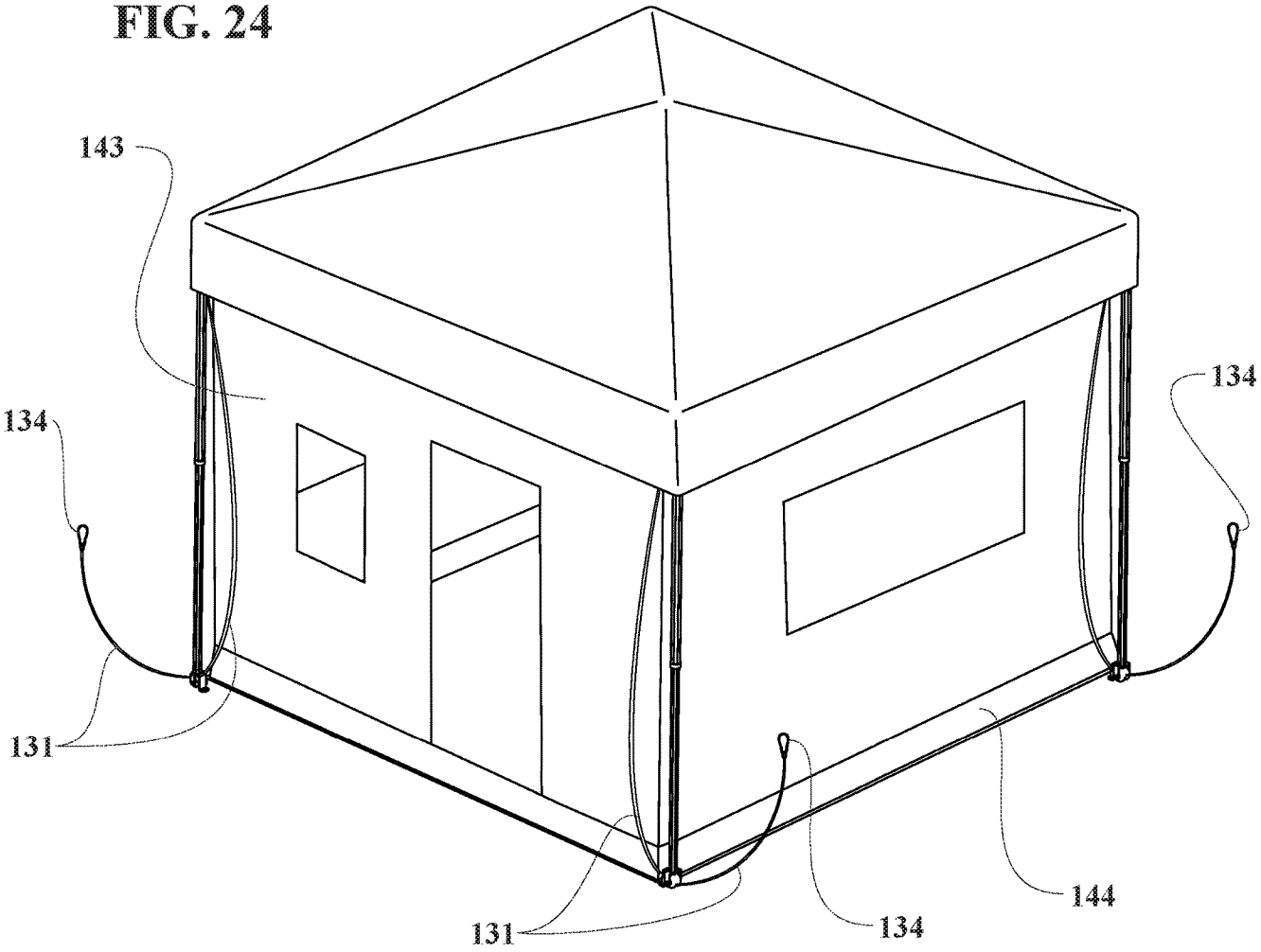
FIG. 24 illustrate perspective views of how cables, carabiners, multi-function latch-pulley-wheels, and multi-function latch-pulley-handles attach mosquito nets to the tick-preventing multi-function-latch-pulley-handle multi-function-latch-pulley-wheel popup.
Figure 25:
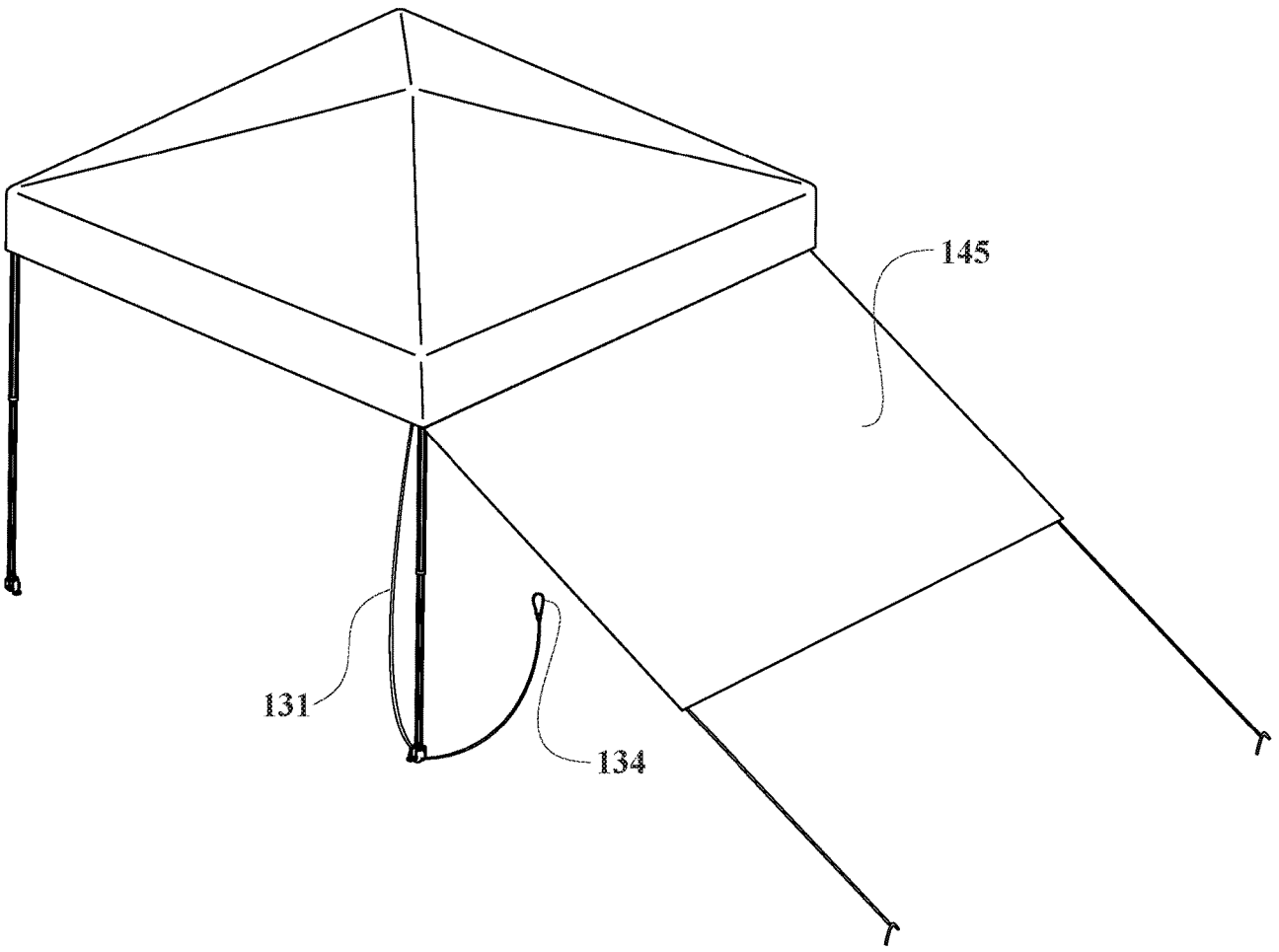
FIG. 25 to FIG. 26 illustrate perspective views of how cables, carabiners, multi-function latch-pulley-wheels, and multi-function latch-pulley-handles attach one or more awnings to the tick-preventing multi-function-latch-pulley-handle multi-function-latch-pulley-wheel popup.
Figure 26:
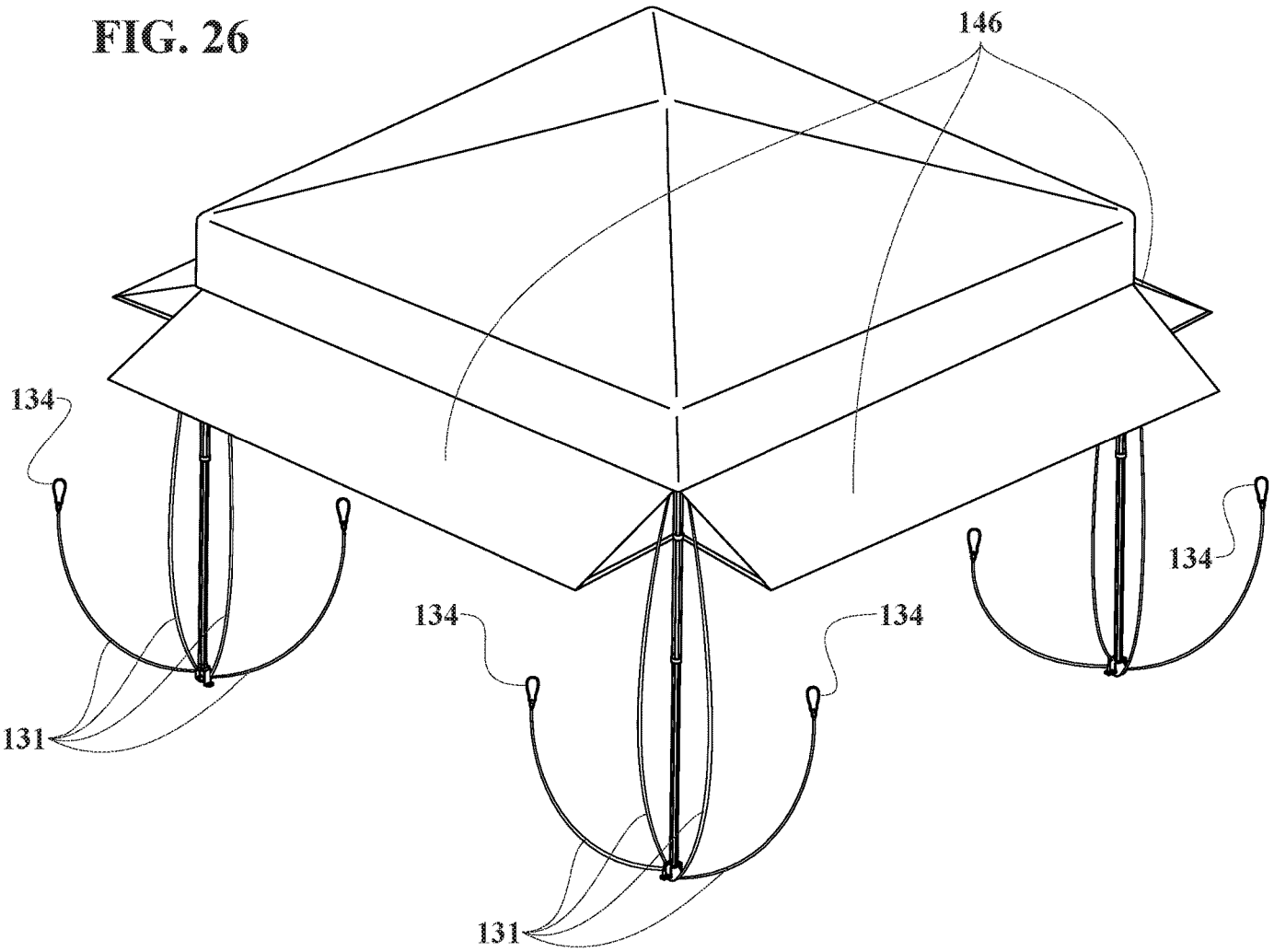
Figure 28:
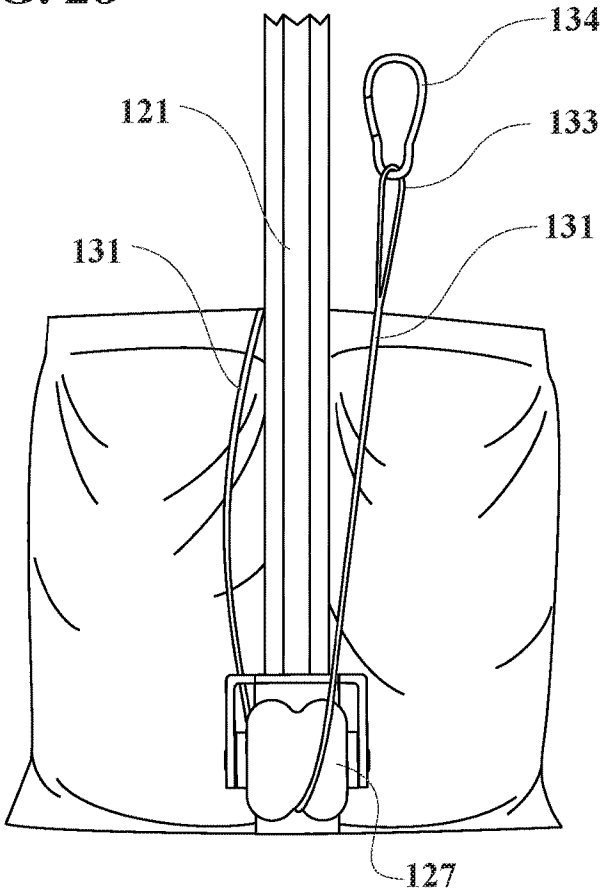
FIG. 27 to FIG. 28 illustrate perspective views of how cables, carabiners, multi-function latch-pulley-wheels, and multi-function latch-pulley-handles attach weight bags to the tick-preventing multi-function-latch-pulley-handle multi-function-latch-pulley-wheel popup.
Figure 27:
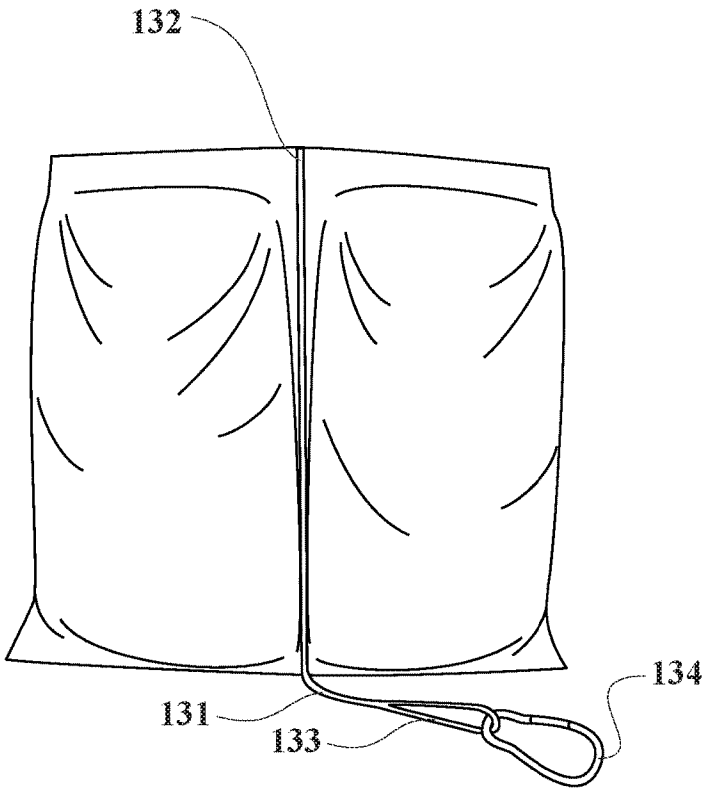

Therefore, the tick-preventing multi-function-latch-pulley-handle and multi-function-latch-pulley-wheel popup:

a) Can be used a latch,
to secure cable thereon to secure popup cover 135,
(see FIG. 17A, FIG. 17B, FIG. 17C, FIG. 18A, FIG. 18B, and FIG. 18C);

b) Can be used to configure the tick-preventing multi-function-latch-pulley-handle and multi-function-latch-pulley-wheel popup,
to utilize a variety of canopy options
(see FIG. 17A, FIG. 17B, FIG. 17C, FIG. 18A, FIG. 18B, and FIG. 18C);

c) Can be used as a pulley for cable,
to secure cable thereon to secure popup cover 135
(see FIG. 17A, FIG. 17B, FIG. 17C, FIG. 18A, FIG. 18B, and FIG. 18C);

d) Can be used together with latch-pulley handle 113,
to reduce forces needed to pull on cable 131 and carabiner 134 to stretch and secure popup cover 135 to cover popup top, popup side and/or popup post
(see FIG. 17A, FIG. 17B, FIG. 17C, FIG. 18A, FIG. 18B, and FIG. 18C);

e) Can be used with cable to tie four lower octagonal posts 121 together,
to create a stronger structure to prevent bending and twisting
(see FIG. 22); and f) Can be used as a wheel,
to roll the tick-preventing multi-function-latch-pulley-handle and multi-function-latch-pulley-wheel popup on the ground for transportation and storage
(see FIG. 15).

6) It is still another object of the new invention to provide a tick-preventing multi-function-latch-pulley-handle and multi-function-latch-pulley-wheel popup, having four automatic rounded-head see-saw post locks 111.

Figure 7:
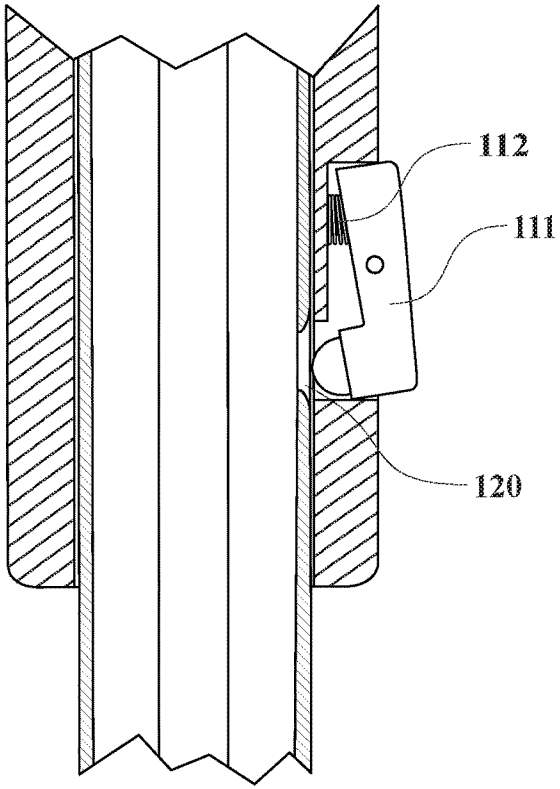
FIG. 6 to FIG. 7 illustrate cross-sectional views of how an automatic rounded-head see-saw post lock automatically snap-locks into a post-height-adjusting tapered hole.
Figure 6:
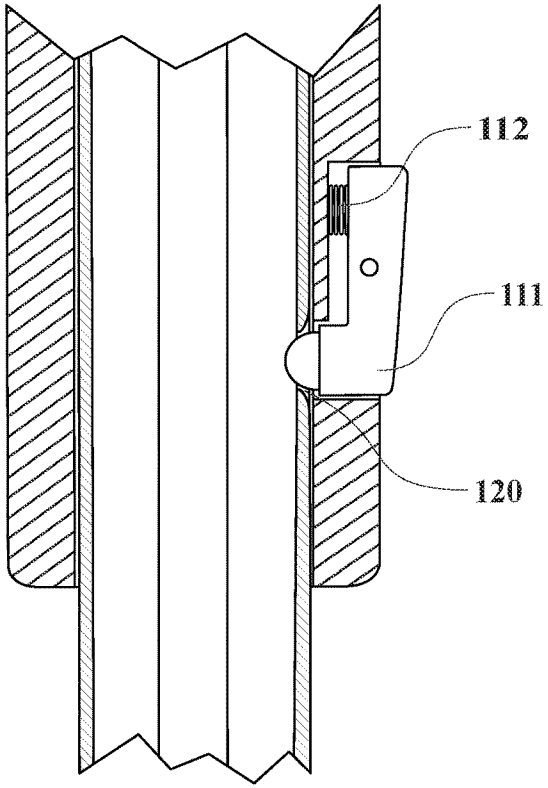
Figure 8:
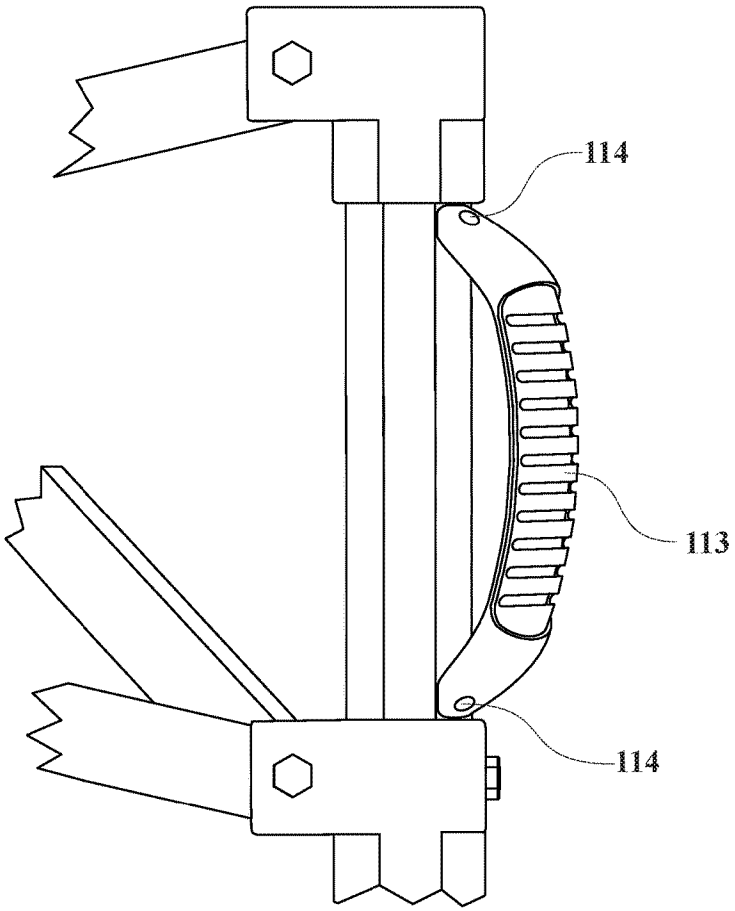
FIG. 8 to FIG. 10 illustrate perspective views of how four multi-function latch-pulley-handles bundle the tick-preventing multi-function-latch-pulley-handle multi-function-latch-pulley-wheel popup.
Figure 9:
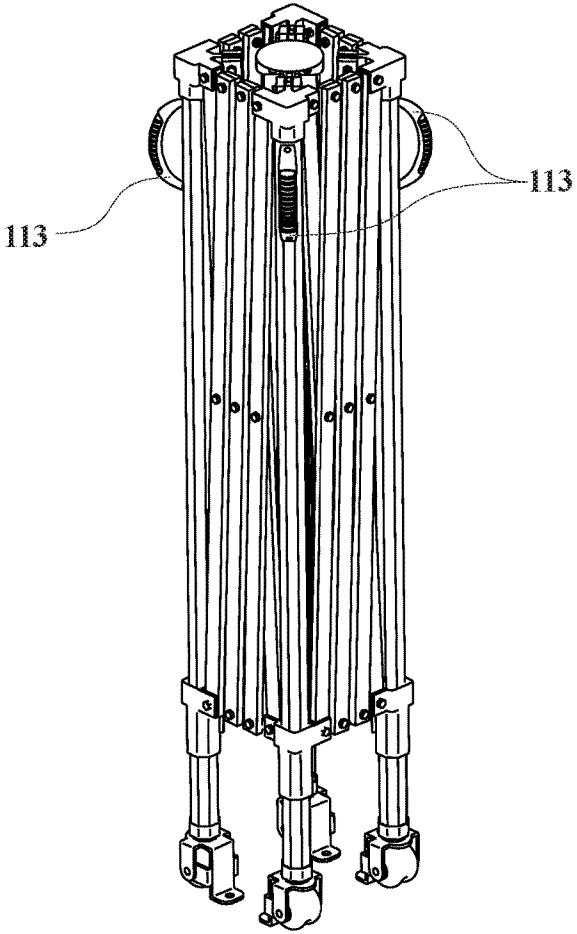

Therefore, the tick-preventing multi-function-latch-pulley-handle and multi-function-latch-pulley-wheel popup:

a) Can quickly and easily lock four lower corner intersectors 110 to four upper octagonal posts 115,
to raise and lower the tick-preventing multi-function-latch-pulley-handle and multi-function-latch-pulley-wheel popup
(see FIG. 6 and FIG. 7);

b) Can conveniently and automatically snap-lock into post-height-adjusting tapered holes 120,
to make adjusting the tick-preventing multi-function-latch-pulley-handle and multi-function-latch-pulley-wheel popup easier
(see FIG. 6 and FIG. 7);

c) Can easily and automatically slip into post-height-adjusting tapered holes 120,
to make adjusting height of the tick-preventing multi-function-latch-pulley-handle and multi-function-latch-pulley-wheel popup easier
(see FIG. 6 and FIG. 7); and d) Can conveniently lock the tick-preventing multi-function-latch-pulley handle and multi-function-latch-pulley-wheel popup,
to keep the tick-preventing multi-function-latch-pulley-handle and multi-function-latch-pulley-wheel popup from collapsing.

7) It is yet another object of the new invention to provide a tick-preventing multi-function-latch-pulley-handle and multi-function-latch-pulley-wheel popup, having four see-saw-post-lock springs 112.

Therefore, the tick-preventing multi-function-latch-pulley-handle and multi-function-latch-pulley-wheel popup:

a) Can automatically pivot four automatic rounded-head see-saw post locks 111 into post-height-adjusting tapered holes 120,
to help aligning four lower corner intersectors 110 to post-height-adjusting tapered holes 120
(see FIG. 6 and FIG. 7);

b) Can easily pivot four automatic rounded-head see-saw post locks 111 in and out of post-height-adjusting tapered holes 120,
to quickly adjust height of the tick-preventing multi-function-latch-pulley-handle and multi-function-latch-pulley-wheel popup;

c) Can easily and automatically and springidly slip into post-height adjusting tapered holes 120,
to make adjusting height of the tick-preventing multi-function-latch-pulley-handle and multi-function-latch-pulley-wheel popup easier
(see FIG. 6 and FIG. 7); and d) Can quickly and easily compress-lock four lower corner intersectors 110 to four upper octagonal posts 115,
to prevent the tick-preventing multi-function-latch-pulley-handle and multi-function-latch-pulley-wheel popup from collapsing
(see FIG. 6 and FIG. 7).

8) It is still yet another object of the new invention to provide a tick-preventing multi-function-latch-pulley-handle and multi-function-latch-pulley-wheel popup, having post-height-adjusting tapered holes 120.

Therefore, the tick-preventing multi-function-latch-pulley-handle and multi-function-latch-pulley-wheel popup:

a) Can automatically slip four automatic rounded-head see-saw post locks 111 into post-height-adjusting tapered holes 120,
to lock four upper octagonal posts 115 to four lower octagonal posts 121
(see FIG. 6 and FIG. 7);

b) Can automatically slip four automatic rounded-head see-saw post locks 111 into post-height-adjusting tapered holes 120,
to help make adjusting the tick-preventing multi-function-latch-pulley-handle and multi-function-latch-pulley-wheel popup easier;

c) Can help prevent water from getting inside four upper octagonal posts 115,
to prevent rusting; and d) Can provide multiple locations of locking for four automatic rounded-head see-saw post locks 111,
to give multiple configuration options to the tick-preventing multi-function-latch-pulley-handle and multi-function-latch-pulley-wheel popup.

What is claimed is:

1. A tick-preventing multi-function-latch-pulley-handle and multi-function-latch-pulley-wheel popup comprising:

a four-way circular roof intersector;

a plurality of foldable roof trusses,
said four-way circular roof intersector bolted to said foldable roof trusses;

a plurality of foldable side trusses;

a plurality of truss holes respectively drilled into said foldable roof trusses and said foldable side trusses;

four upper corner intersectors,
said foldable roof trusses respectively bolted to said four-way circular roof intersector and said four upper corner intersectors;

four lower corner intersectors;

four automatic rounded-head see-saw post locks respectively hinged to said four lower corner intersectors;

four see-saw-post-lock springs respectively attached between said four lower corner intersectors and said four automatic rounded-head see-saw post locks;

four multi-function latch-pulley-handles;

four upper octagonal posts,
said four upper octagonal posts having a plurality of top ends,
said four upper octagonal posts having a plurality of bottom ends,
said four upper corner intersectors respectively bolted to said foldable roof trusses and
said foldable side trusses, and attached to said top ends of said four upper octagonal posts,
said four lower corner intersectors respectively bolted to said foldable roof trusses and
said foldable side trusses, and slid over said four upper octagonal posts,
said four multi-function latch-pulley-handles respectively riveted to said four upper octagonal posts;

four multi-function post-centering water-discharging tick-preventing braces respectively slid on said bottom ends of said four upper octagonal posts,
said four multi-function post-centering water-discharging tick-preventing braces having a plurality of inner surfaces;

a plurality of tick-preventing downward teeth respectively molded on said inner surfaces of said four multi-function post-centering water-discharging tick-preventing braces;

a plurality of water-discharging recesses respectively molded on said inner surfaces of said four multi-function post-centering water-discharging tick-preventing braces;

four V-shaped post-locking springs;

a plurality of post-height-adjusting tapered holes respectively drilled into said four upper octagonal posts;

four lower octagonal posts respectively slid into said four upper octagonal posts,
said four upper octagonal posts respectively slip over said four lower octagonal posts,
said four V-shaped post-locking springs respectively springably inserted inside
said four lower octagonal posts,
said post-height-adjusting tapered holes respectively drilled into said four upper octagonal posts and said four lower octagonal posts;

four wheel chassis respectively welded onto said four lower octagonal posts;

four wheel braces respectively cast to said wheel chassis;

a plurality of wheel-axle holes respectively drilled into said four wheel braces;

four wheel axles respectively attached to said wheel-axle holes;

four multi-function latch-pulley-wheels respectively rotatably slid on said four wheel axles;

four post ankles respectively cast to said four wheel chassis;

four post feet respectively cast to said four post ankles; and four stake holes respectively drilled into said four post feet, wherein said four multi-function latch-pulley-handles respectively are for functioning as a latch to bundle said foldable side trusses to secure said tick-preventing multi-function-latch-pulley-handle and multi-function-latch-pulley-wheel popup in a closed position for storage, functioning as a handle to tow said tick-preventing multi-function-latch-pulley-handle and multi-function-latch-pulley-wheel popup on said four multi-function latch-pulley-wheels, functioning as a handle to deploy said tick-preventing multi-function-latch-pulley-handle and multi-function-latch-pulley-wheel popup on said four multi-function latch-pulley-wheels, functioning as a pulley to work together with said four multi-function latch-pulley-wheels to reduce forces needed to pull on a cable hooked thereon, said four multi-function latch-pulley-wheels respectively are for functioning as a latch to hook a cable thereon to secure said tick-preventing multi-function-latch-pulley-handle and multi-function-latch-pulley-wheel popup, functioning as a wheel to transport said tick-preventing multi-function-latch-pulley-handle and multi-function-latch-pulley-wheel popup, functioning as a pulley to work together with said four multi-function latch-pulley-handles to reduce forces needed to pull on a cable hooked thereon, said four multi-function post-centering braces respectively are for slidably centering said four lower octagonal posts inside said four upper octagonal posts, said tick-preventing downward teeth respectively are for preventing ticks from entering and hiding inside said four upper octagonal posts, said water-discharging recesses respectively are for allowing rain water to drain away from inside said four upper octagonal posts to prevent said four upper octagonal posts from rusting.

2. The tick-preventing multi-function-latch-pulley-handle and multi-function-latch-pulley-wheel popup of claim 1, further comprising a plurality of intersector holes;

a plurality of bolts; and a plurality of nuts, wherein said intersector holes respectively are molded into said four-way circular roof intersector, said four upper corner intersectors, and said four lower corner intersectors for screwing said bolts therethrough, said bolts respectively are inserted through said intersector holes for attaching said four-way circular roof intersector, said foldable roof trusses, said foldable side trusses, said upper corner intersectors, and said four lower corner intersectors together, said nuts respectively are screwed onto said bolts for securing said bolts.

3. The tick-preventing multi-function-latch-pulley-handle and multi-function-latch-pulley-wheel popup of claim 1, wherein said four multi-function latch-pulley-handles each are made of rubber or nylon material.

4. The tick-preventing multi-function-latch-pulley-handle and multi-function-latch-pulley-wheel popup of claim 1, wherein said four automatic rounded-head see-saw post locks each are made of plastic material, said four see-saw-post-lock springs each are made of metallic material.

5. The tick-preventing multi-function-latch-pulley-handle and multi-function-latch-pulley-wheel popup of claim 1, wherein said four multi-function post-centering water-discharging tick-preventing braces each are made of plastic material, said water-discharging recesses each are made of empty space.

6. The tick-preventing multi-function-latch-pulley-handle and multi-function-latch-pulley-wheel popup of claim 1, wherein said tick-preventing downward teeth each have a zig-zag-tooth shape.

7. The tick-preventing multi-function-latch-pulley-handle and multi-function-latch-pulley-wheel popup of claim 1, wherein said four multi-function latch-pulley-wheels each have a circular-wheel-or-pulley shape.

8. The tick-preventing multi-function-latch-pulley-handle and multi-function-latch-pulley-wheel popup of claim 1, wherein said tick-preventing multi-function-latch-pulley-handle and multi-function-latch-pulley-wheel popup is made of plastic, metallic, rubber, nylon, and plasticized materials.

9. The tick-preventing multi-function-latch-pulley-handle and multi-function-latch-pulley-wheel popup of claim 1, wherein said tick-preventing multi-function-latch-pulley-handle and multi-function-latch-pulley-wheel popup is made of plastic, metallic, rubber, nylon, or plasticized materials.

10. A tick-preventing latch-pulley-handle and latch-pulley-wheel popup comprising:

a four-way circular roof intersector;

a plurality of foldable roof trusses, said four-way circular roof intersector bolted to said foldable roof trusses;

a plurality of foldable side trusses;

a plurality of truss holes respectively drilled into said foldable roof trusses and said foldable side trusses;

four upper corner intersectors, said foldable roof trusses respectively bolted to said four-way circular roof intersector and said four upper corner intersectors;

four lower corner intersectors;

four automatic rounded-head see-saw post locks respectively hinged to said four lower corner intersectors;

four see-saw-post-lock springs respectively attached between said four lower corner intersectors and said four automatic rounded-head see-saw post locks;

four multi-function latch-pulley-handles;

four upper octagonal posts, said four upper octagonal posts having a plurality of top ends, said four upper octagonal posts having a plurality of bottom ends, said four upper corner intersectors respectively bolted to said foldable roof trusses and said foldable side trusses, and attached to said top ends of said four upper octagonal posts, said four lower corner intersectors respectively bolted to said foldable roof trusses and said foldable side trusses, and slid over said four upper octagonal posts, said four multi-function latch-pulley-handles respectively riveted to said four upper octagonal posts;

four multi-function post-centering water-discharging tick-preventing braces respectively slid on said bottom ends of said four upper octagonal posts, said four multi-function post-centering water-discharging tick-preventing braces having a plurality of inner surfaces;

a plurality of tick-preventing downward teeth respectively molded on said inner surfaces of said four multi-function post-centering water-discharging tick-preventing braces;

four V-shaped post-locking springs;

a plurality of post-height-adjusting tapered holes respectively drilled into said four upper octagonal posts;

four lower octagonal posts respectively slid into said four upper octagonal posts, said four upper octagonal posts respectively slip over said four lower octagonal posts, said four V-shaped post-locking springs respectively springably inserted inside said four lower octagonal posts, said post-height-adjusting tapered holes respectively drilled into said four upper octagonal posts and said four lower octagonal posts;

four wheel chassis respectively welded onto said four lower octagonal posts;

four wheel braces respectively cast to said wheel chassis;

a plurality of wheel-axle holes respectively drilled into said four wheel braces;

four wheel axles respectively attached to said wheel-axle holes;

four multi-function latch-pulley-wheels respectively rotatably slid on said four wheel axles;

four post ankles respectively cast to said four wheel chassis; and four post feet respectively cast to said four post ankles.

11. The tick-preventing latch-pulley-handle and latch-pulley-wheel popup of claim 10, further comprising a plurality of intersector holes;

a plurality of bolts; and a plurality of nuts, wherein said intersector holes respectively are molded into said four-way circular roof intersector, said four upper corner intersectors, and said four lower corner intersectors for screwing said bolts therethrough, said bolts respectively are inserted through said intersector holes for attaching said four-way circular roof intersector, said foldable roof trusses, said foldable side trusses, said upper corner intersectors, and said four lower corner intersectors together, said nuts respectively are screwed onto said bolts for securing said bolts.

12. The tick-preventing latch-pulley-handle and latch-pulley-wheel popup of claim 10, wherein said four multi-function latch-pulley-handles each are made of rubber or nylon material.

13. The tick-preventing latch-pulley-handle and latch-pulley-wheel popup of claim 10, wherein said four automatic rounded-head see-saw post locks each are made of plastic material, said four see-saw-post-lock springs each are made of metallic material.

14. The tick-preventing latch-pulley-handle and latch-pulley-wheel popup of claim 10, wherein said four multi-function post-centering water-discharging tick-preventing braces each are made of plastic material.

15. The tick-preventing latch-pulley-handle and latch-pulley-wheel popup of claim 10, wherein said tick-preventing downward teeth each have a zig-zag-tooth shape.

16. The tick-preventing latch-pulley-handle and latch-pulley-wheel popup of claim 10, wherein said four multi-function latch-pulley-wheels each have a circular-wheel-or-pulley shape.

17. The tick-preventing latch-pulley-handle and latch-pulley-wheel popup of claim 10, wherein said tick-preventing latch-pulley-handle and multi-function-latch-pulley-wheel popup is made of plastic, metallic, rubber, nylon, and plasticized materials.

18. The tick-preventing latch-pulley-handle and latch-pulley-wheel popup of claim 10, wherein said tick-preventing latch-pulley-handle and multi-function-latch-pulley-wheel popup is made of plastic, metallic, rubber, nylon, or plasticized materials.

19. A popup comprising:

a four-way circular roof intersector;

a plurality of foldable roof trusses, said four-way circular roof intersector bolted to said foldable roof trusses;

a plurality of foldable side trusses;

a plurality of truss holes respectively drilled into said foldable roof trusses and said foldable side trusses;

four upper corner intersectors, said foldable roof trusses respectively bolted to said four-way circular roof intersector and said four upper corner intersectors;

four lower corner intersectors;

four automatic rounded-head see-saw post locks respectively hinged to said four lower corner intersectors;

four see-saw-post-lock springs respectively attached between said four lower corner intersectors and said four automatic rounded-head see-saw post locks;

four upper posts, said four upper posts having a plurality of top ends, said four upper posts having a plurality of bottom ends, said four upper corner intersectors respectively bolted to said foldable roof trusses and said foldable side trusses, and attached to said top ends of said four upper posts, said four lower corner intersectors respectively bolted to said foldable roof trusses and said foldable side trusses, and slid over said four upper posts;

four multi-function post-centering water-discharging tick-preventing braces respectively slid on said bottom ends of said four upper posts;

four post-locking springs;

a plurality of post-height-adjusting tapered holes respectively drilled into said four upper posts;

four lower posts respectively slid into said four upper posts, said four upper posts respectively slip over said four lower posts, said four post-locking springs respectively springably inserted inside said four lower posts, said post-height-adjusting tapered holes respectively drilled into said four upper posts and said four lower posts;

four wheel chassis respectively welded onto said four lower posts;

four wheel braces respectively cast to said wheel chassis;

a plurality of wheel-axle holes respectively drilled into said four wheel braces;

four wheel axles respectively attached to said wheel-axle holes;

four latch-pulley-wheels respectively rotatably slid on said four wheel axles;

four post ankles respectively cast to said four wheel chassis; and four post feet respectively cast to said four post ankles.

20. The popup of claim 19, wherein said popup is made of plastic, metallic, rubber, nylon, or plasticized materials.

* * * * *